US011918124B2

(12) United States Patent
Kapij et al.

(10) Patent No.: US 11,918,124 B2
(45) Date of Patent: Mar. 5, 2024

(54) INTELLIGENT AUTOMATED CHAIR AND METHODS OF USING THE SAME

(71) Applicants: Mark Kapij, Lexington, MA (US); Jose Chavarria, Arcata, CA (US)

(72) Inventors: Mark Kapij, Lexington, MA (US); Jose Chavarria, Arcata, CA (US)

( * ) Notice: Subject to any disclaimer, the term of this patent is extended or adjusted under 35 U.S.C. 154(b) by 197 days.

(21) Appl. No.: 17/338,631

(22) Filed: Jun. 3, 2021

(65) Prior Publication Data

US 2021/0386213 A1 Dec. 16, 2021

Related U.S. Application Data

(60) Provisional application No. 63/034,071, filed on Jun. 3, 2020.

(51) Int. Cl.

| | |
|---|---|
| ***A47C 31/12*** | (2006.01) |
| ***A47C 3/24*** | (2006.01) |
| ***A47C 7/72*** | (2006.01) |

(52) U.S. Cl.

CPC ..... *A47C 31/126* (2013.01); *A47C 3/24* (2013.01); *A47C 7/72* (2013.01)

(58) Field of Classification Search

CPC ..... G06N 20/00; A47C 9/002; A47C 9/025; B60N 2/0244

See application file for complete search history.

(56) References Cited

U.S. PATENT DOCUMENTS

| | | | | |
|---|---|---|---|---|
| 5,435,623 | A * | 7/1995 | Kapec | A47C 9/005 297/284.11 |
| 5,536,067 | A * | 7/1996 | Pinto | A47C 7/024 297/215.15 |
| 2012/0086252 | A1 | 4/2012 | Hong | |
| 2015/0366350 | A1* | 12/2015 | Di Censo | A61B 5/1128 700/275 |
| 2016/0183687 | A1 | 6/2016 | Hoyt et al. | |
| 2016/0324713 | A1 | 11/2016 | Halperin | |
| 2017/0027323 | A1 | 2/2017 | Probst et al. | |
| 2019/0125609 | A1 | 5/2019 | Mason et al. | |
| 2020/0148076 | A1* | 5/2020 | Main | B60N 2/04 |
| 2021/0316711 | A1* | 10/2021 | Wu | B60N 2/5685 |

FOREIGN PATENT DOCUMENTS

| | | | |
|---|---|---|---|
| WO | 1993017604 | A1 | 9/1993 |
| WO | 2014033108 | A1 | 3/2014 |

* cited by examiner

*Primary Examiner* — Sarah B McPartlin

(74) *Attorney, Agent, or Firm* — Lambert Shortell & Connaughton; David J. Connaughton, Jr.; Justin P. Tinger

(57) ABSTRACT

An intelligent automated chair that is configured to have uploaded various operating models to run a sequence of patterns that cause the intelligent automated chair to alternate between various positions. An intelligent automated chair system configured to receive data from various inputs including user input, sensors, biosensors, historical usage, profile, and others to generate a recommended operating model for the intelligent automated chair. An intelligent automated chair system running an operating model that is interruptible manually by a user or as a result of sensed date, which can alter the pattern or parameters of the operating model.

21 Claims, 21 Drawing Sheets

100

100

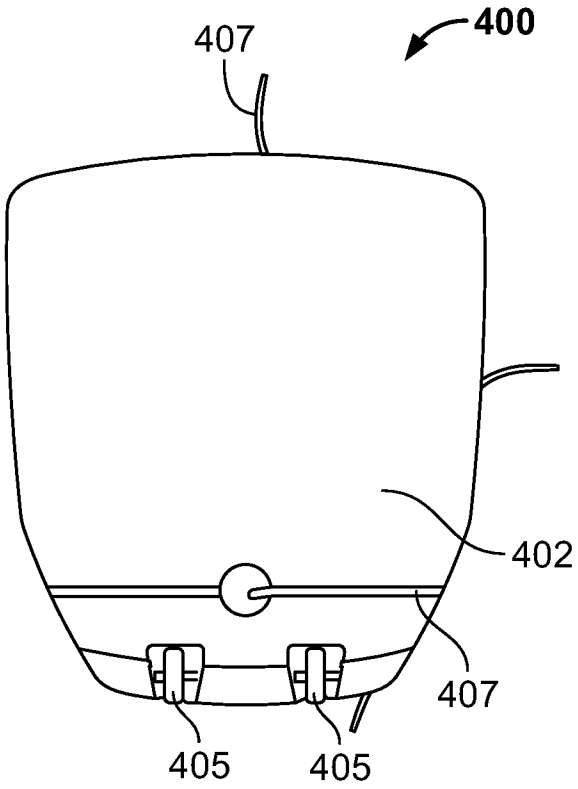
FIG. 4C
FIG. 4B
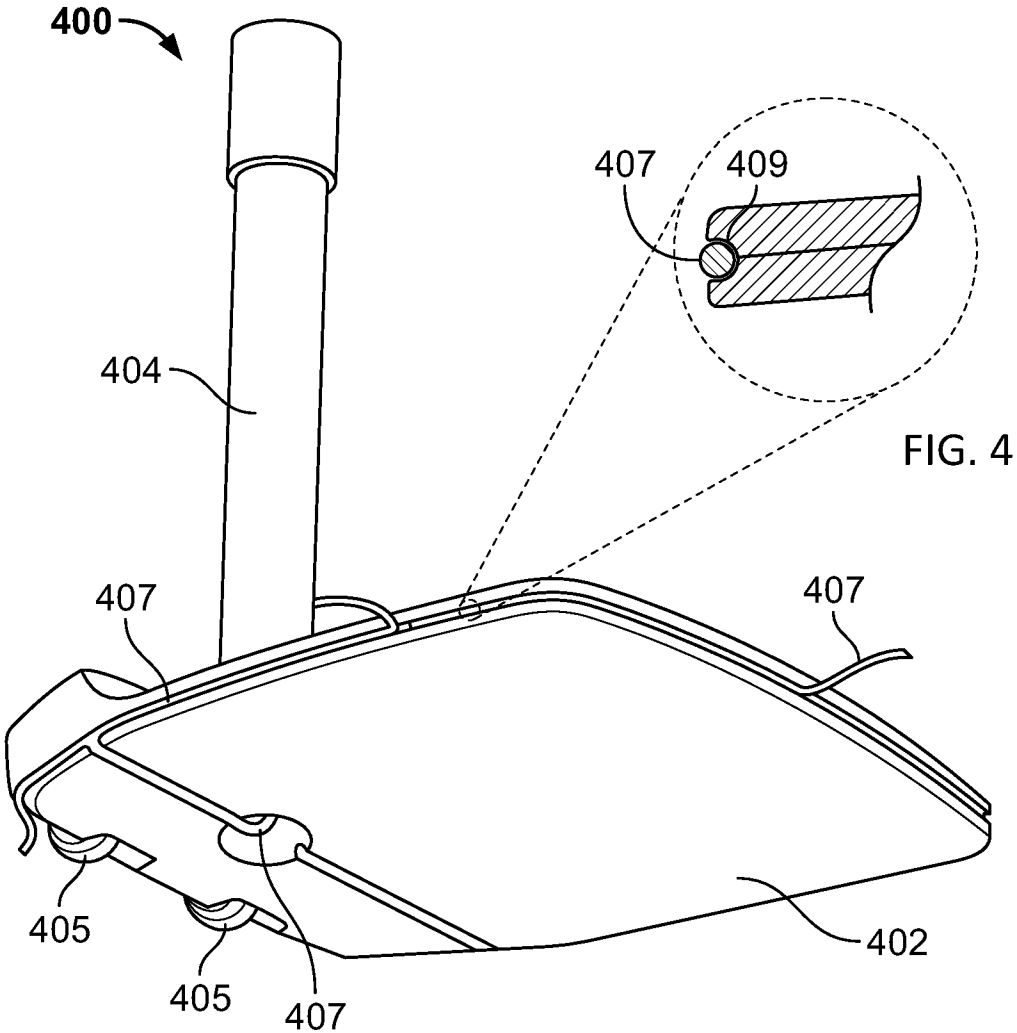
FIG. 4A

600

600

INTELLIGENT AUTOMATED CHAIR AND METHODS OF USING THE SAME

CROSS-REFERENCE TO RELATED APPLICATIONS

This application claims the benefit of U.S. Provisional Patent Application No. 63/034,071 filed on Jun. 3, 2020; which is herein incorporated by reference in entirety.

TECHNICAL FIELD

The present disclosure generally relates to the field of office furniture, and more particularly to office furniture automated to increase health benefits.

BACKGROUND

Office furniture has historically been designed to provide comfort for working hours on end. However, being in one position for extended periods of time can have negative impacts on your health. One such article that documents the need to switch positions frequently is *Rethinking design parameters in the search for optimal dynamic seating* by Jennifer Pynt, PhD, Grad Dip Manip Ther, Dip Physio published by the Journal of Bodywork & Movement Therapies (2015) 19, 291-303. In this particular article, it illustrates the negative effects of 10-20 minutes of sustained slouched sitting. Similarly, standing too long in the same position can also have negative impacts. Thu Apps have been used to try to remind individuals to get up and move, and sometimes utilize step counters or other sensors attached to smartphones or smartwatches to determine how long it has been since the last time a person stood up or took a certain number of steps within a time period. These indicators can be turned off and ignored. By ignoring these reminders, the individuals do not take advantage of the benefits from standing up regularly during the day. Some users try to utilize standing desks and though positive can still place a certain strain if used for the entire day or long duration. Thus, a solution is needed to allow for natural adjustments in position in response to biosensor and other calculated recommendations. The present application seeks to provide this and other solutions that will be apparent to those in the art.

SUMMARY OF THE INVENTION

Several embodiments are provided about an intelligent automated chair that is configured to have uploaded various operating models to run a sequence of patterns that cause the intelligent automated chair to alternate between various positions. An intelligent automated chair system configured to receive data from various inputs including user input, sensors, biosensors, historical usage, profile, and others to generate a recommended operating model for the intelligent automated chair. An intelligent automated chair system running an operating model that is interruptible manually by a user or as a result of sensed date, which can alter the pattern or parameters of the operating model.

In one embodiment, an intelligent automated chair system comprises an automated chair that comprises: a base portion; a vertical support extending from the base portion; a horizontal support interfacing the vertical support; a right leaf, configured to be driven by a motor in response to an input to alter between positions of horizontal and vertical; a left leaf, configured to be driven by a motor in response to an input to alter between positions of horizontal and vertical; and an automated control assembly positioned about the horizontal support and connected to the right leaf and the left leaf, and configured to receive input data from one or more sensors and create an adjustment to at least one portion of the automated chair based on the received input data.

This above embodiment can include one or more sensors are biosensors. These biosensors can be attached to third party devices and configured to wirelessly communicate with the automated chair. The one or more biosensors can also be configured to send biosensed data to an intelligent analysis module that is run on a cloud-based system.

The intelligent analysis module can be configured to generate an automated operating model and communicate the automated operating model to the automated control assembly. This automated operating model can include parameters about a pattern of automatically shifting the positions of the automated chair, including durations between each shift, wherein the durations can be different for each position.

In the above embodiment the automated control assembly can include a control system and at least one motor. It can also include a gearbox and an output mechanism configured to raise and lower the right leaf and left leaf. The control system can include a processor and memory. The control system can also operate a learning algorithm to update the automated operating model.

In some variations, the automated control assembly is configured to receive and execute an operating model that has information about automatically changing positions of the automated chair according to the operating model. The system is configured after executing and running the operating model to be interrupted. The interruptions can be a result of a sensed information or a result of a user-initiated input.

The automated control assembly is configured to use the information associated with the interruption to update the operating model.

The intelligent automated chair system embodiment can further include a notification means configured to notify a user when a position change is about to occur. The notification means can include one of haptic feedback, sound, or visual notifications.

The intelligent automated chair system embodiment can further include a posture detecting mechanism configured to determine if a posture threshold is being met. When determining a posture threshold has not being met, the system can execute by the automated control assembly either a notification or a position change, such as raising or lowering the right or left leaf.

The intelligent automated chair system embodiment can further include an intelligent analysis module that is run on a cloud-based system. The intelligent analysis module is configured to receive at least two of usage information, profile information, user input data, and biosensed data to generate an operating model.

The intelligent automated chair system embodiment, can further include a training model uploaded to the automated control assembly, which is configured to monitor and record usage information associated with a user including the sequence of position changes and the duration between each position change. This recorded usage information can be used in the intelligent analysis module to generate a recommended operating model for the user. User input data can also be used to generate the recommended operating model.

The automated chair in some variations includes a back rest.

In yet another embodiment an intelligent automated chair system comprises an automated chair comprising: a base portion; a vertical support extending from the base portion; a horizontal support interfacing the vertical support; a right leaf, configured to be driven by a motor in response to an input to alter between positions of horizontal and vertical; a left leaf, configured to be driven by a motor in response to an input to alter between positions of horizontal and vertical; and an automated control assembly positioned about the horizontal support and connected to the right leaf and the left leaf, and configured to receive an updatable operating model based on at least one of profile information, biosensed data, or usage data.

In this embodiment the automated control assembly is configured to execute the updatable operating model, which causes position changes to the automated chair according to the updatable operating model.

In this embodiment the automated chair can further include a plurality of sensors in communication with the automated control assembly. The plurality of sensors can be configured to determine if a natural input is received by user that is indicative of changing a position of the automated chair. The operating model can be updated according to the natural inputs receive as well as usage information about the natural inputs and the positions of the automated chair generated as a result.

In yet another embodiment a method creating an operating model for an intelligent automated chair comprising the steps of: receiving biosensor data associated with a user profile; receiving usage data of the intelligent automated chair that is associated with the user profile; receiving user input data from a user associated with the user profile; generating the operating model based on the received biosensor data, usage data and user input data.

Again, contemplated herein is an intelligent automated chair that is configured to adjust based on desired health benefits and biosensor feedback. It can utilize cloud-based systems to run pattern and other learning algorithms to generate operating models based on the biosensor feedback which can include SPO2 levels, heart rate, step count determined from a pedometer, movement or motion data determined from a sensing device, and so forth. This information can be in real-time as well as stored historical data over a period of time.

Additional detail and description is provide below.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention, wherein:

FIGS. 4A-C illustrate various views of the base portion of an intelligent automated chair including electrical power and wheels.

DETAILED DESCRIPTION OF THE INVENTION

Figure 1A:
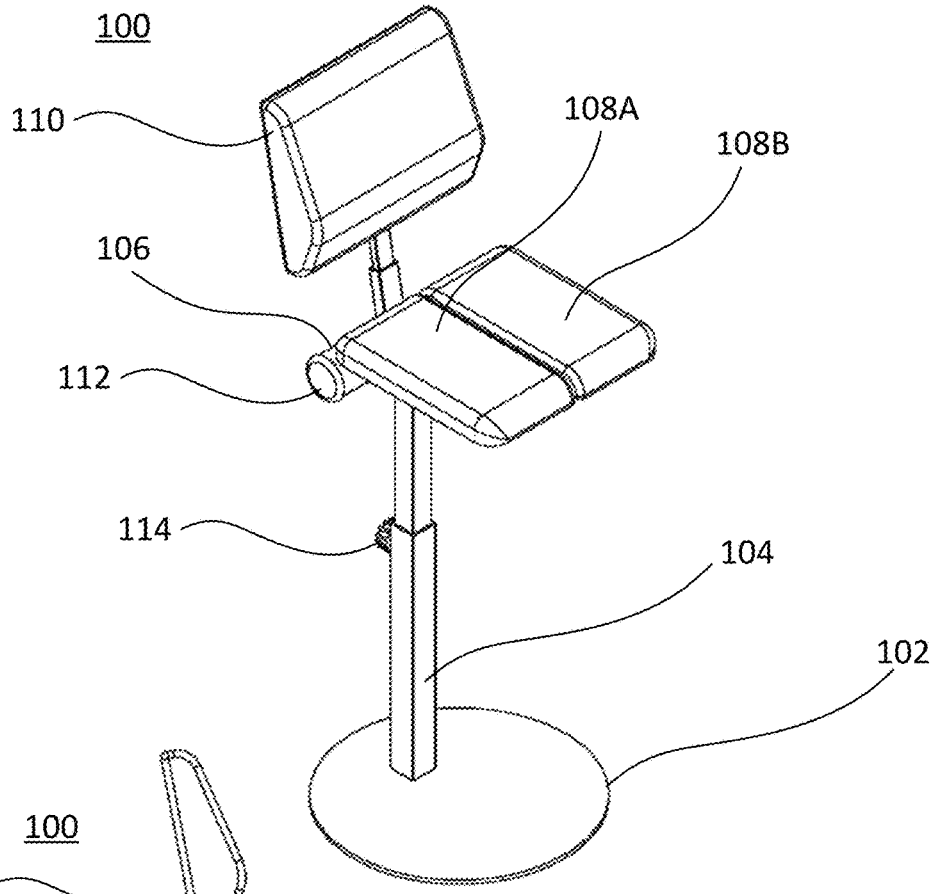
FIGS. 1A-G illustrate various views of an embodiment of an intelligent automated chair.
Figure 1B:
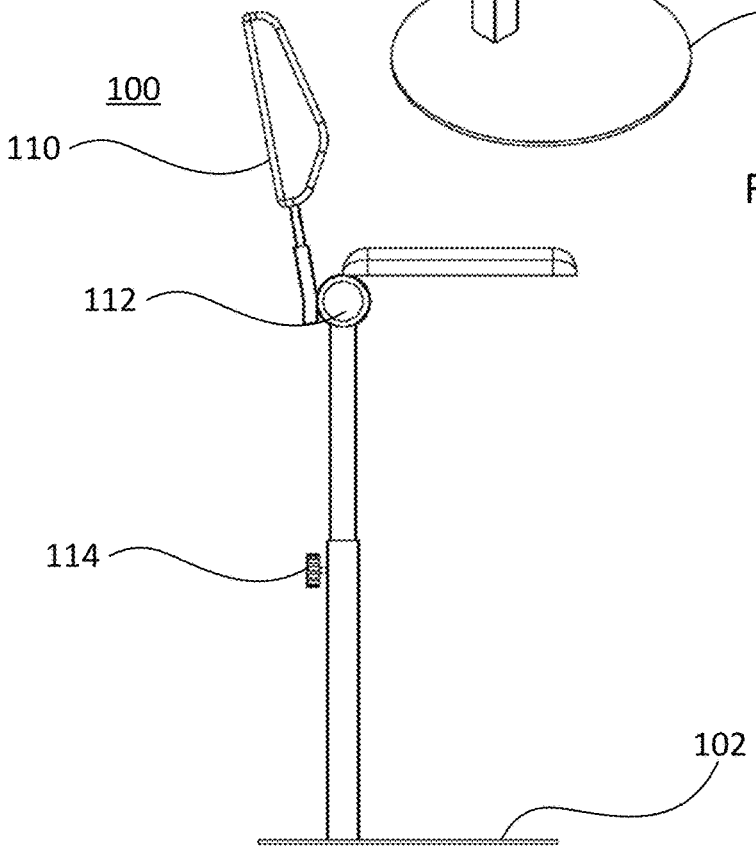
Figure 1C:
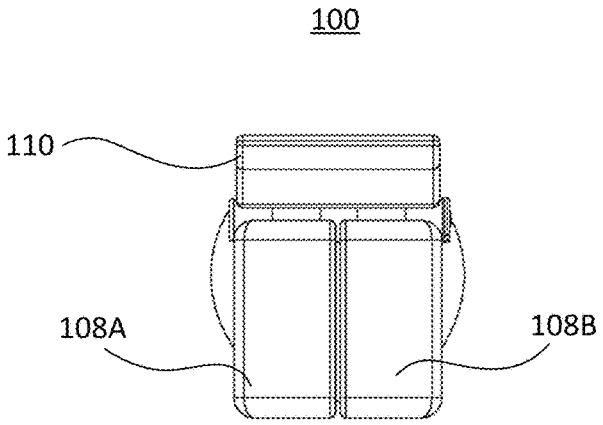
Figure 1D:
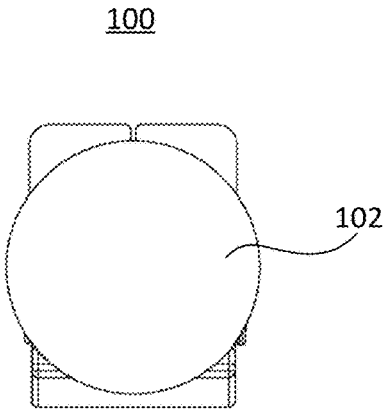
Figure 1E:
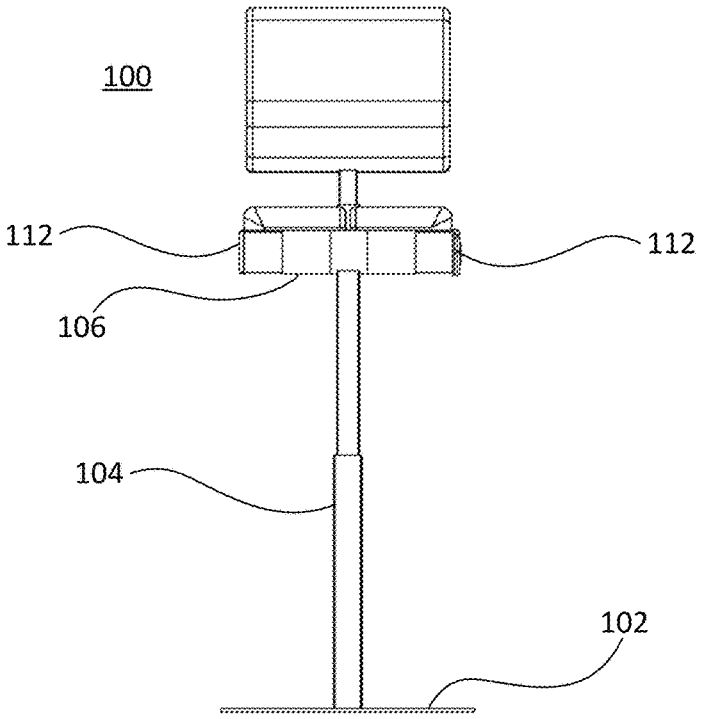
Figure 1F:
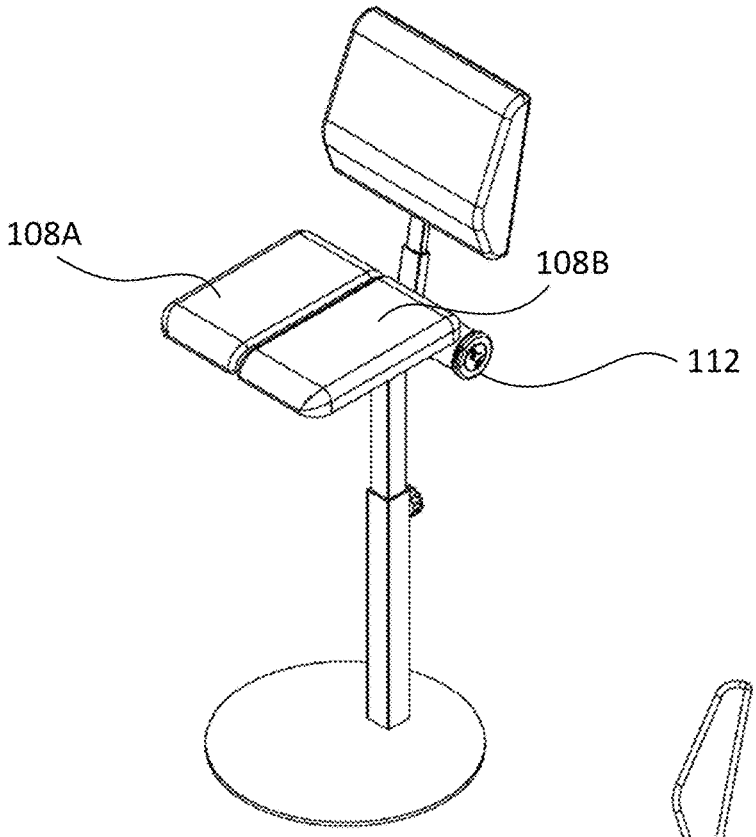
Figure 1G:
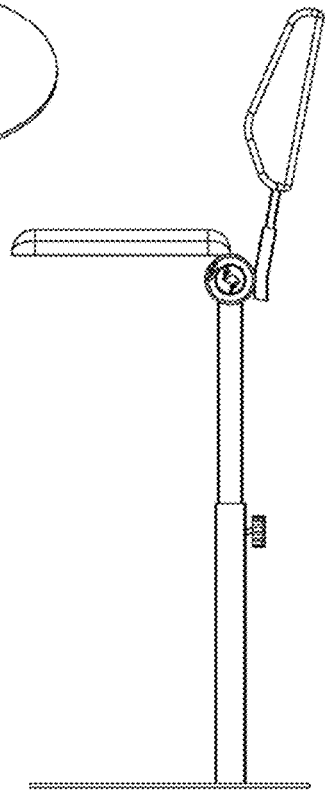

As noted in the background one of the problems that present application is seeking to address is to minimize disrupting a person's work, while introducing an optimal amount of activity in the person to provide health benefits. Some of the health benefits for example can include slightly increasing the heart rate with some motion, which can allow the spinal disks to get nutrition via diffusion. By shifting positions periodically muscle fatigue and strain on various parts of the body are reduced. A slight increase in blood flow can also help with increasing oxygen to the brain, which can help with focus and concentration, which is often needed when performing various tasks at a desk, such as coding, legal work, accounting, engineering work, and so forth.

One of the proposed solutions to the problem described above involves automatically causing a user to shift chair positions based at least in part on biosensor feedback.

For purposes of this description additional description to certain terms is provided that include information in addition to those terms ordinary meaning to provide clarity.

Biosensor or biosensor feedback includes information associated with a user's health, body, or interactions with a user's body, which has been received by a sensing device or system configured to detect or determine such information. Examples include heart rate information, SpO2 levels, calories burned, weight of a user, number of steps the user has taken, skin pH levels, levels of compounds or minerals in blood, sweat, or urine, exposure to sunlight, hours slept including the various types of sleep cycles the user experienced, and so forth. These examples are meant to exemplary and not limited.

Sensors include any device or mechanism that is configured to detect anything and can be inclusive of biosensors. Additional sensed examples could include the presence of a user, load on each of the right or left leaves of the chair, pressure or weight sensors in the base or foot rest of the chair, and so forth. These may or may not be directly associated with a user's health. The presence of user can be performed by IR detection, Bluetooth proximity detection with a user's smartphone, weight detection by stepping onto the base of the chair and so forth. This presence detection is not necessarily associated with a user's health, but can indicate that the user is in proximity of the chair and begin operating according to an operating model associated with that user.

The term cloud refers to one or more computing devices, such as servers, that are generally located remotely from the user or intelligent automated chair. The cloud can be used to run algorithms and pattern detection models, to generate and recommend the appropriate operating model for a particular user.

Mobile computing device can include smartphones, tablets, laptops and even smartwatches that have wireless communication means, some processing capabilities configured to run an application and memory.

Several embodiments of intelligent automated chairs are disclosed herein. In one embodiment shown FIGS. 1A-G an intelligent automated chair 100 includes a base 102, a vertical support 104, and a horizontal support 106, which is configured to house a motor and control systems. The motor and control systems are configured to operate and alternate the right leaf 108A and left leaf 108B in various positions that will be shown in other embodiments below. A control interface 112 is disposed on either side of the horizontal support 106. Extending from the vertical support or alternatively from the horizontal support in some versions is a backrest 110. The vertical support can include a height adjustment mechanism 114. As shown in this embodiment 100, the height adjustment mechanism is a manual adjustment, but in other versions this can be automated adjustment.

Figure 2B:
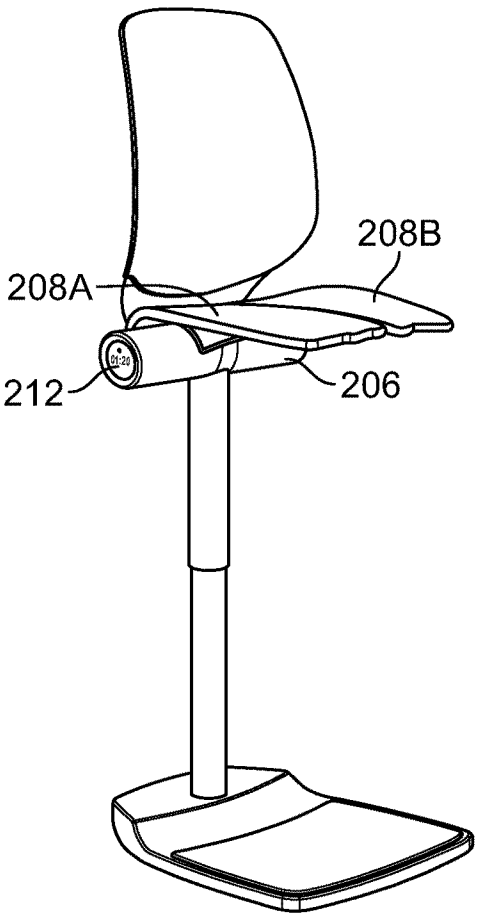
FIGS. 2A-B illustrate various views of another embodiment of an intelligent automated chair.
Figure 2A:
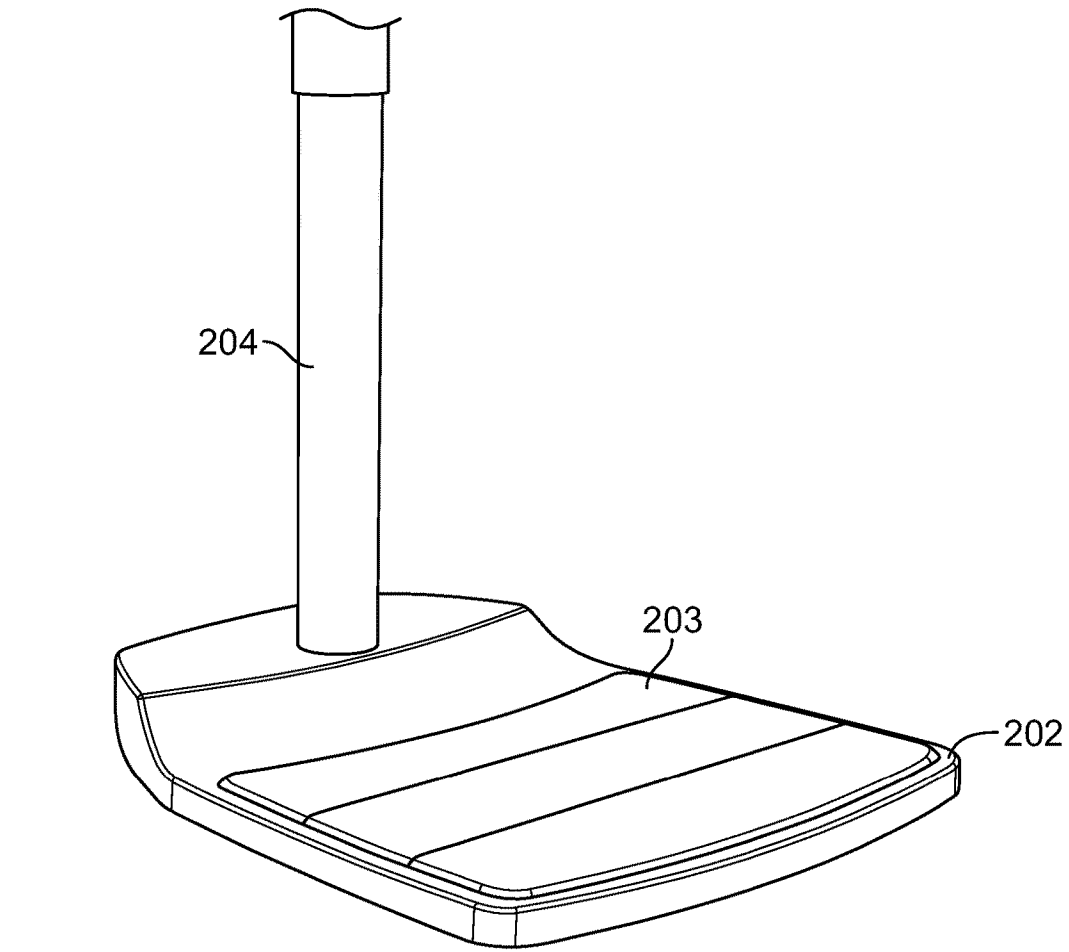

FIGS. 2A-B illustrate another embodiment of an intelligent automated chair 200, which includes a base 202, attached to a vertical support 204. Base 202 has a textured surface 203 configured to have a layer of cushion and support when a user is in the standing position. The textured surface is also configured to be a non-slip surface in certain embodiments. Similar to embodiment 100, 200 also includes a control interface 212 on horizontal support 206, which is connected to right leaf 208A and left leaf 208A.

Figure 3B:
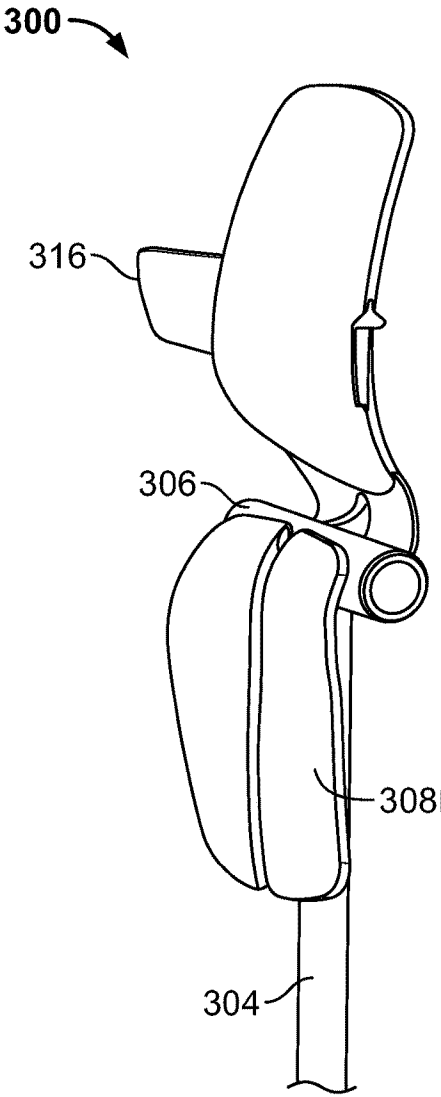
FIGS. 3A-B illustrate various views of another embodiment of an intelligent automated chair with arm rests.
Figure 3A:
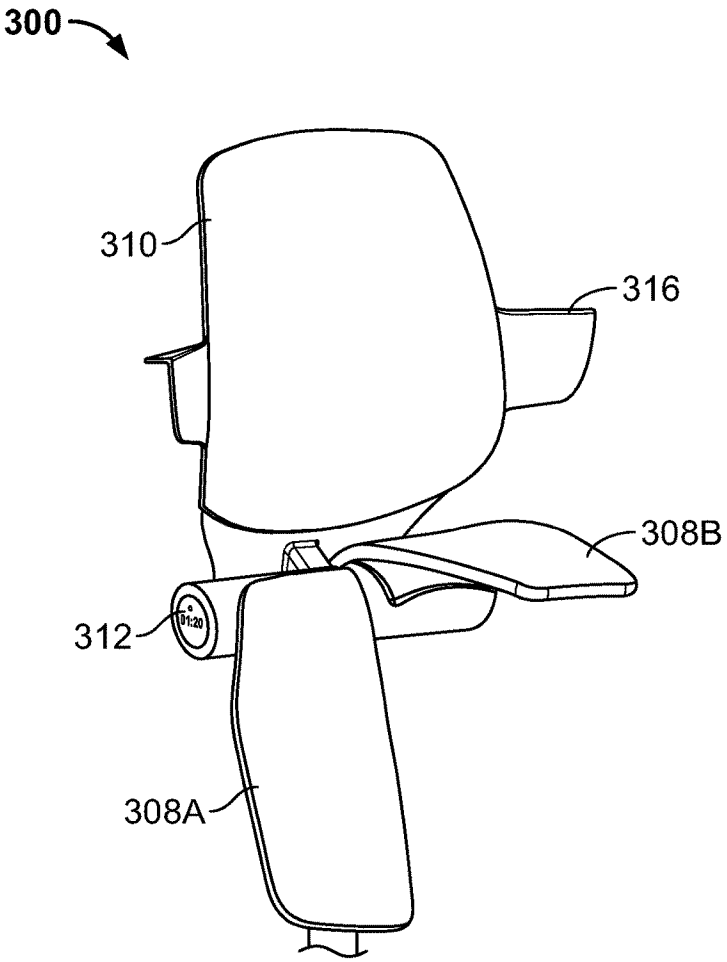

FIGS. 3A-B illustrate another embodiment of an intelligent automated chair 300, illustrating version that includes armrests 316 that extend from the backrest 310. FIG. 3A illustrates how the motor and control systems disposed at least partially in the horizontal support 306 can lower right leaf 308A, while maintaining a horizontal position to left leaf 308A. In FIG. 3B, both right and leaf 308A, 308B are lowered to be vertically aligned with the vertical support 304. These different configurations positions of the seat portion, which is comprised of right and left leaf 308A, 308B, can be controlled using at least control interface 312. Other mechanisms of controlling the positions, timing, and other adjustments of the seat portion will be described below.

FIGS. 4A-C illustrate another embodiment of an intelligent automated chair 400, that illustrates routing of power through the base portion 402 and the vertical support 404. As shown, various channels 409 can be formed on the underside of the base 402 as well as along the edges of 402 to guide an electrical cord 407 that can provide power to the intelligent automated chair 400. Also shown are wheels 405 that are attached near the back portion of the base 402 that can be used when moving the intelligent automated chair 400. It should be understood that the various features of embodiments 100-400 can be integrated across each other as well other embodiments that will be described later.

Figure 5A:
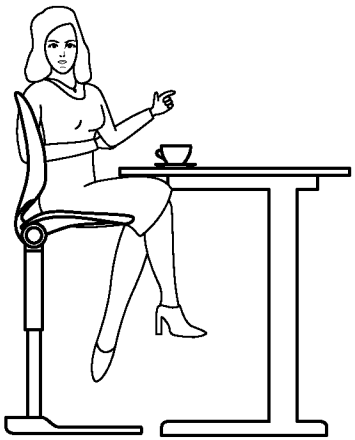
FIGS. 5A-D illustrate a change in position of an intelligent automated chair and the various configurations or positions a user could utilize the intelligent automated chair.
Figure 5B:
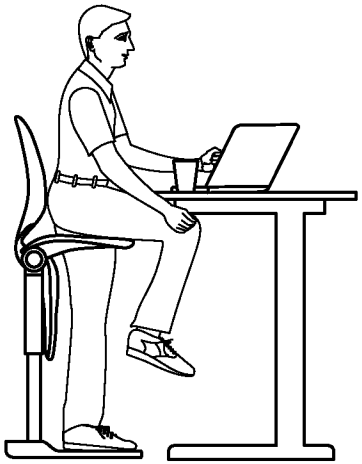
Figure 5C:
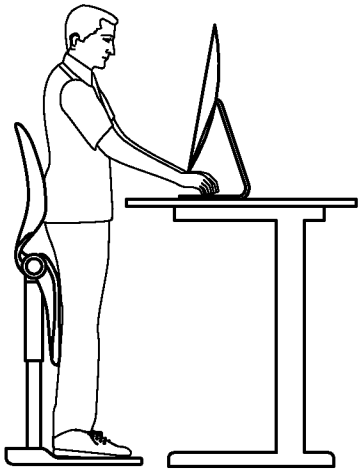
Figure 5D:
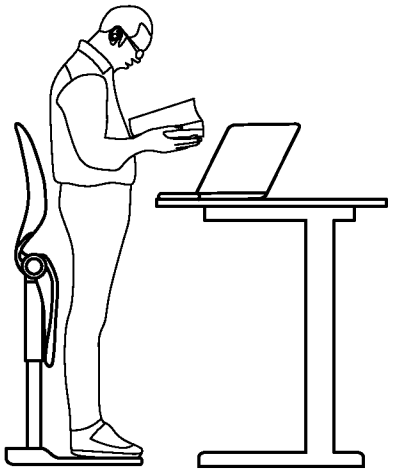

FIGS. 5A-D illustrate a change in position of an intelligent automated chair and the various configurations or positions a user could position themselves about the intelligent automated chair. For example, as shown in FIG. 5A, a user could be fully sat on the intelligent automated chair. In this fully sitting position both the right and left leaves are fixed in a horizontal position. After a period of time, the user can transition to a position shown in FIG. 5B where either the right or left leaf is lowered. In this position the user is standing on one leg (either the right or left leg) while resting the other leg or approximately half of the buttocks on the leaf of the seat that is in the horizontal position. The user can alternate standing on one leg while partially sitting from right side to left side. FIG. 5C illustrates another a position the user can utilize the intelligent automated chair where the user is in a standing position, but still leaning their backside on the vertical portion of the intelligent automated chair. In FIG. 5D, the user is standing free of the chair on the base area, and not leaning on the intelligent automated chair at all. By switching between each of these positions the user can benefit from some of the health benefits noted above.

FIGS. 5A-D illustrate also that the intelligent automated chair can be used with a desk or table or type of workstation, which should be readily understood from reading this description. A workstation generally includes a chair, desk, computing device, monitor and other various office supplies.

FIGS. 6A-F illustrate various views of an intelligent automated chair 600 without a backrest. Similar to the embodiments described above, chair 600 includes a base 602, connected to a vertical support 604, which is connected to the horizontal support 606, which includes the automated control assembly therein, which is comprised in part of motors and a control system. The horizontal support 606 is mechanically connected to the right leaf 608A and left leaf 608B, which form the seat and are raised and lowered by the automated control assembly. As noted, this version does not include a backrest or armrests. However, this version includes a foot rest 618 that includes a foot rest adjustment mechanism 620. The foot rest 618 feature can be incorporated into any of the above embodiments. The foot rest 618 is designed to allow a user to rest their feet on when in the full sitting position. The foot rest adjustment mechanism 620 can be a manually adjustable mechanism, which is configured to extend the foot rest further away from the seat or can adjust the height of the foot rest. It can also be an automated system, such as the vertical height mechanism 614 disposed internally in the vertical support 604 and driven by the motor and control system.

Figure 6B:
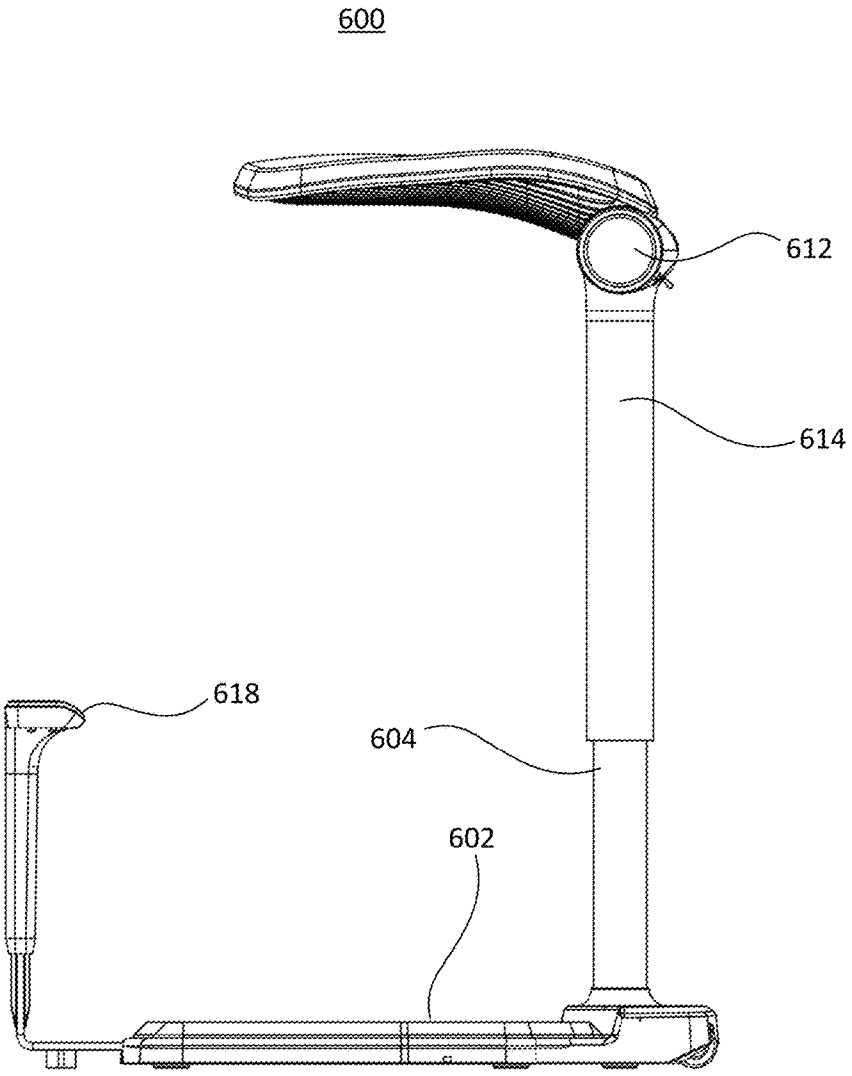
FIGS. 6A-F illustrates various configurations of a version of an intelligent automated chair without a backrest.
Figure 6A:
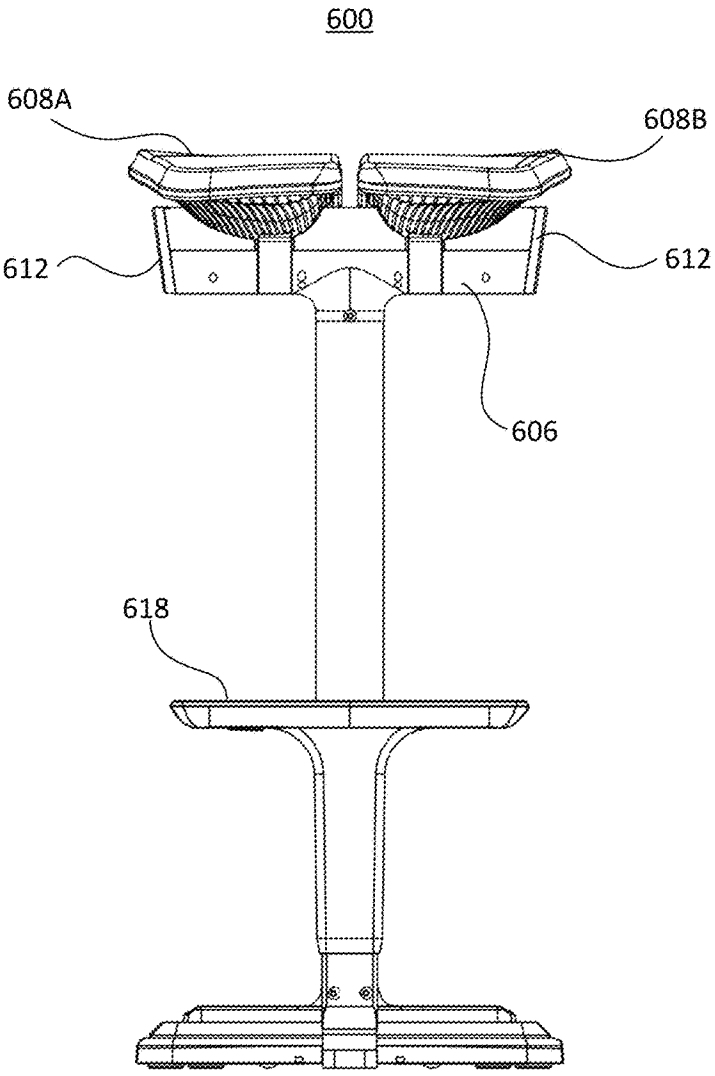
Figure 6D:
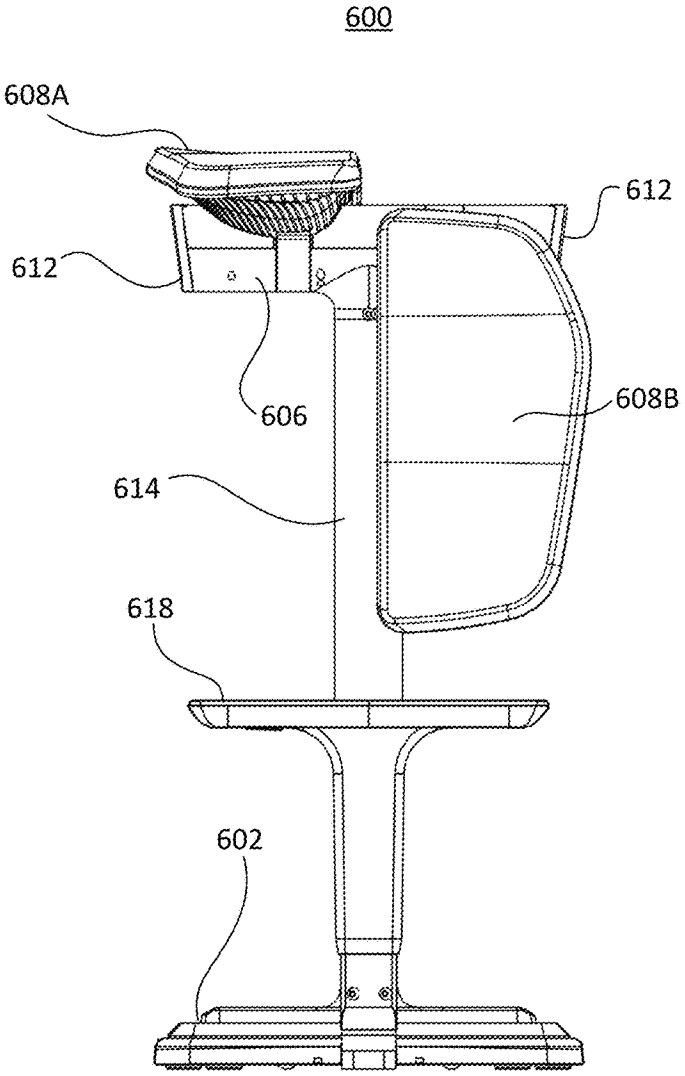
Figure 6C:
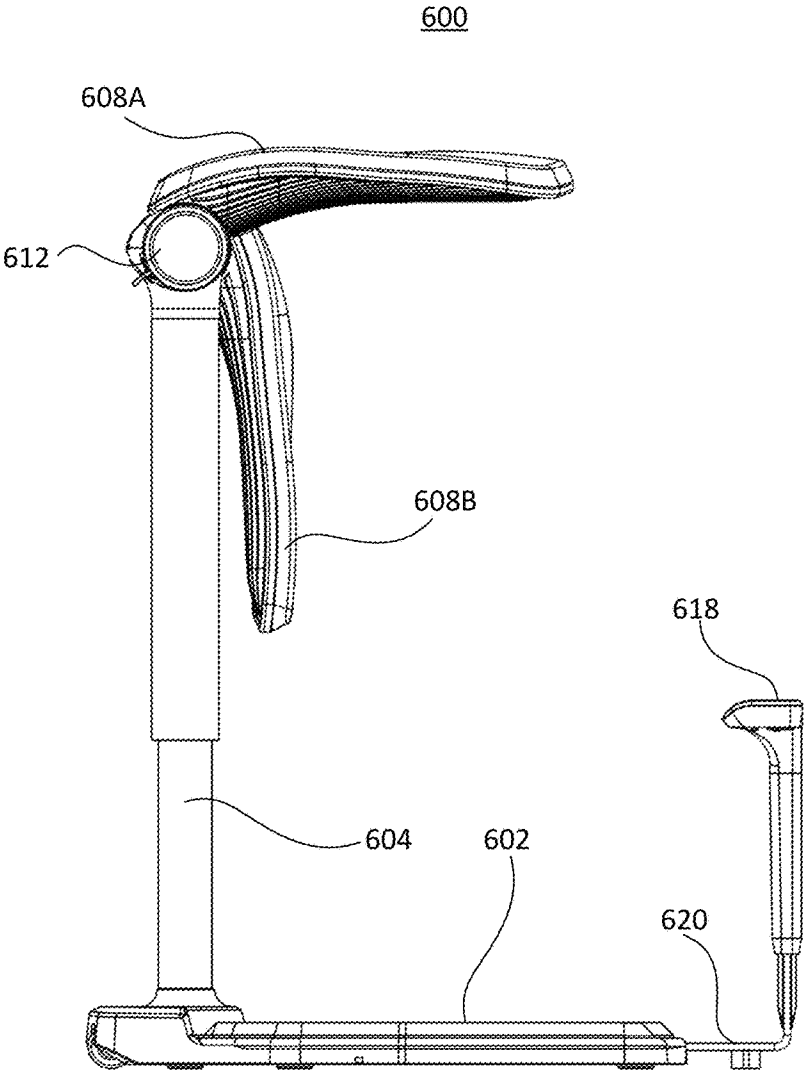
Figure 6F:
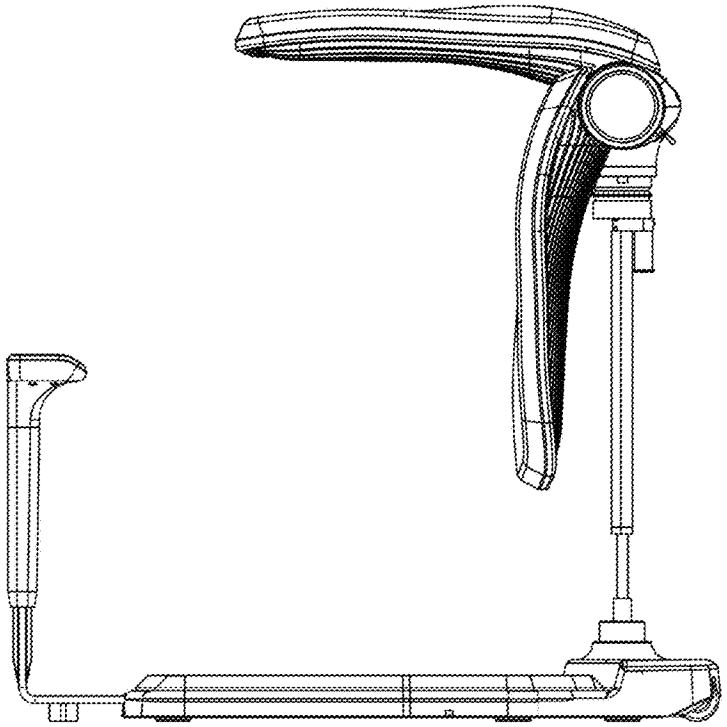
Figure 6E:
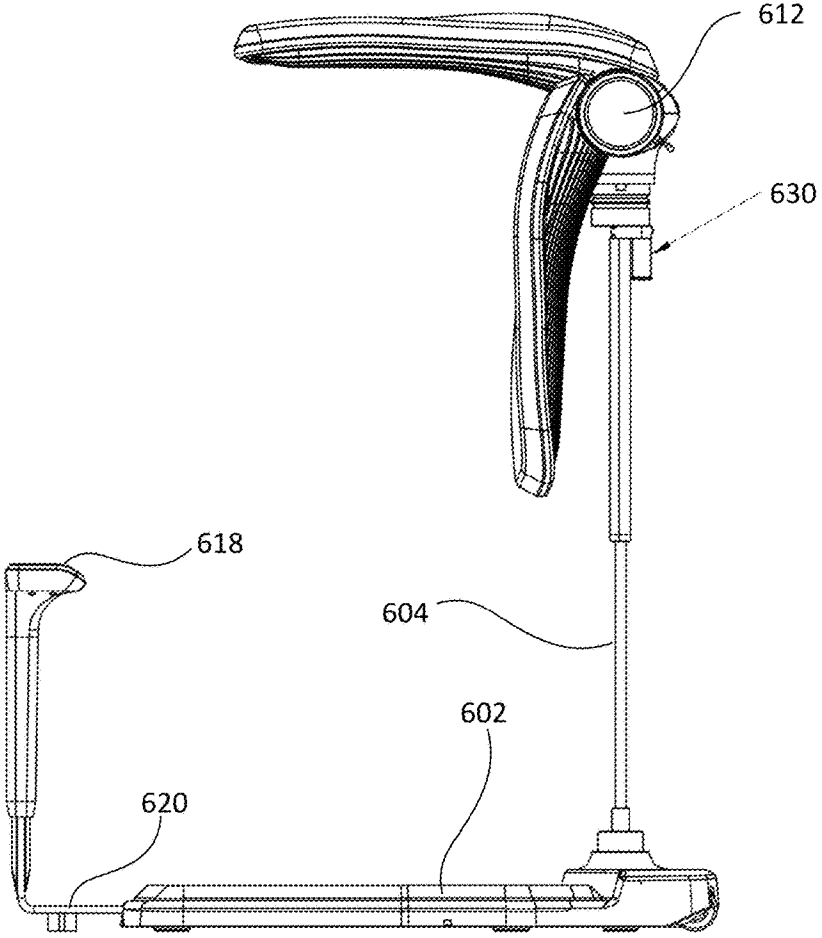

FIG. 6A illustrates a front view of intelligent automated chair 600 in a configuration where both the right and left leaf components are both upright. A side view of this configuration is shown in FIG. 6B. FIGS. 6C-D illustrate 600 in a configuration where the left leaf component 608B is lowered, while 608A is maintained in a horizontal position. This allows the user to be in the on-leg standing position, where the left leg is standing and the right leg is sitting or resting on the right leaf. FIGS. 6E-F illustrate a configuration where the vertical support 604 has an integrated electric linear motor 630 integrated therein. The electric linear motor 630 can allow the height of the intelligent automated chair 600 to be automatically raised or lowered. This automatic raising can by done by user input, such as user input to one of the control interfaces 612, user input into a wireless connected device running an app.

Figure 7A:
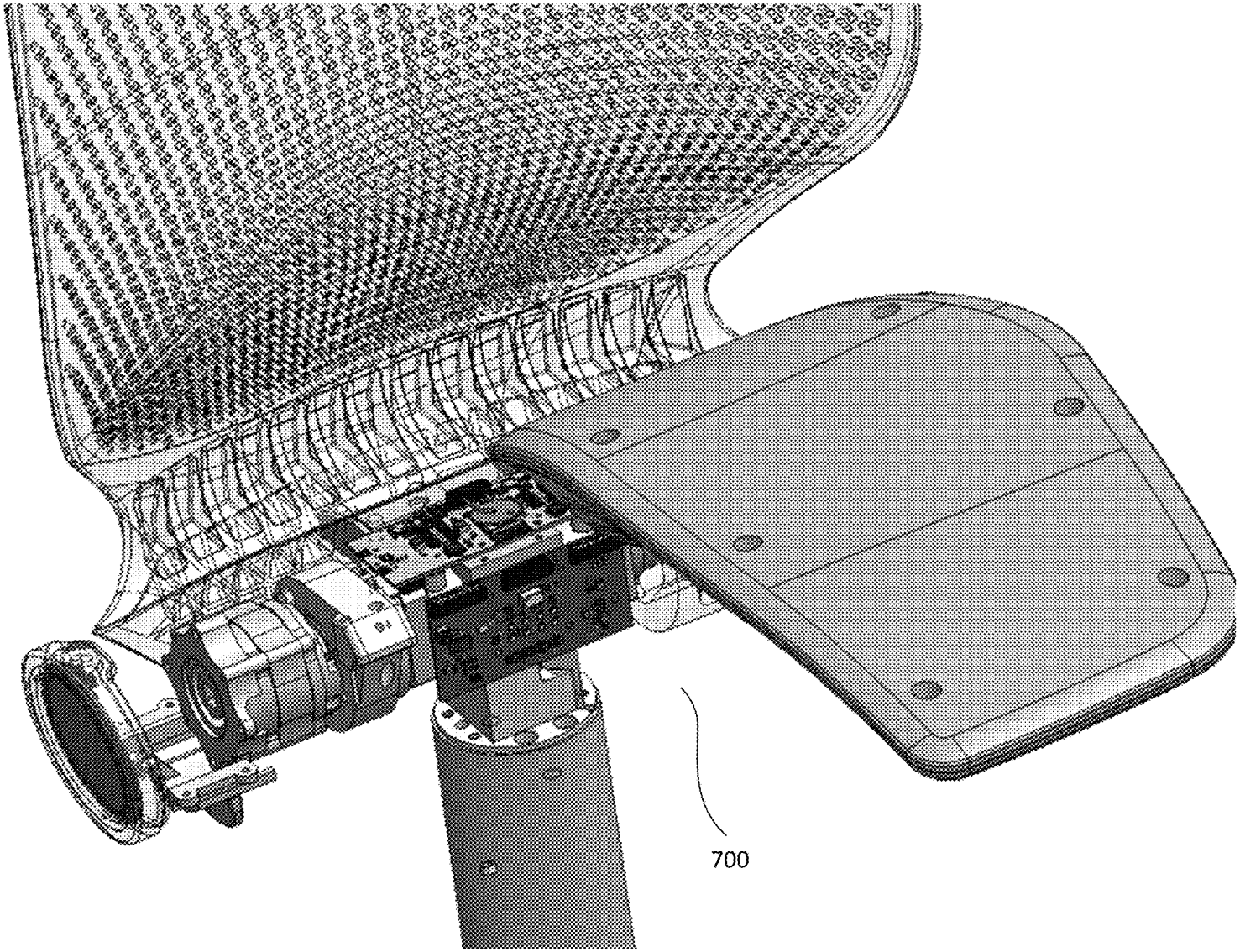
FIGS. 7A-C illustrate various views of the automated control assembly used in the intelligent automated chairs.
Figure 7B:
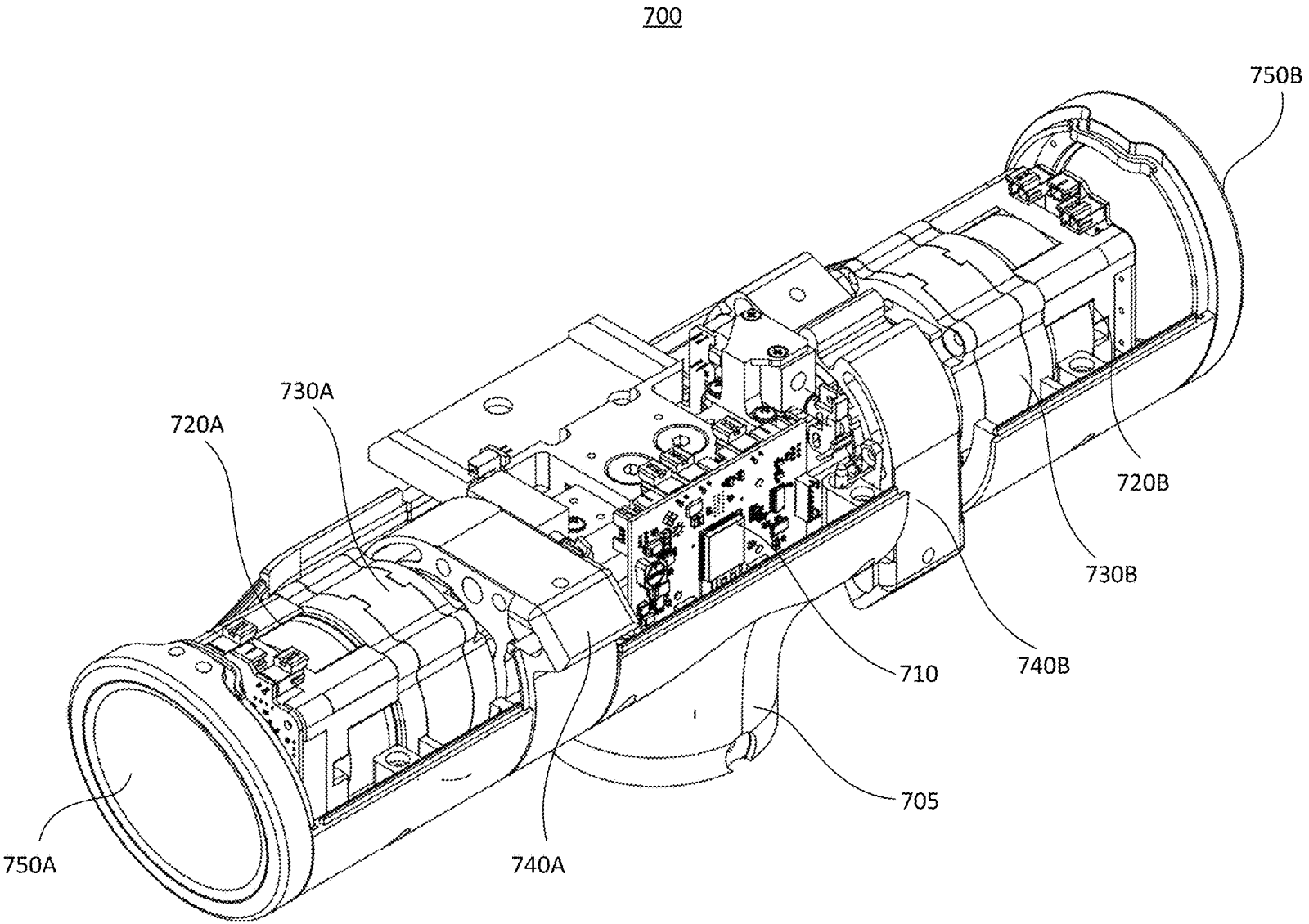
Figure 7C:
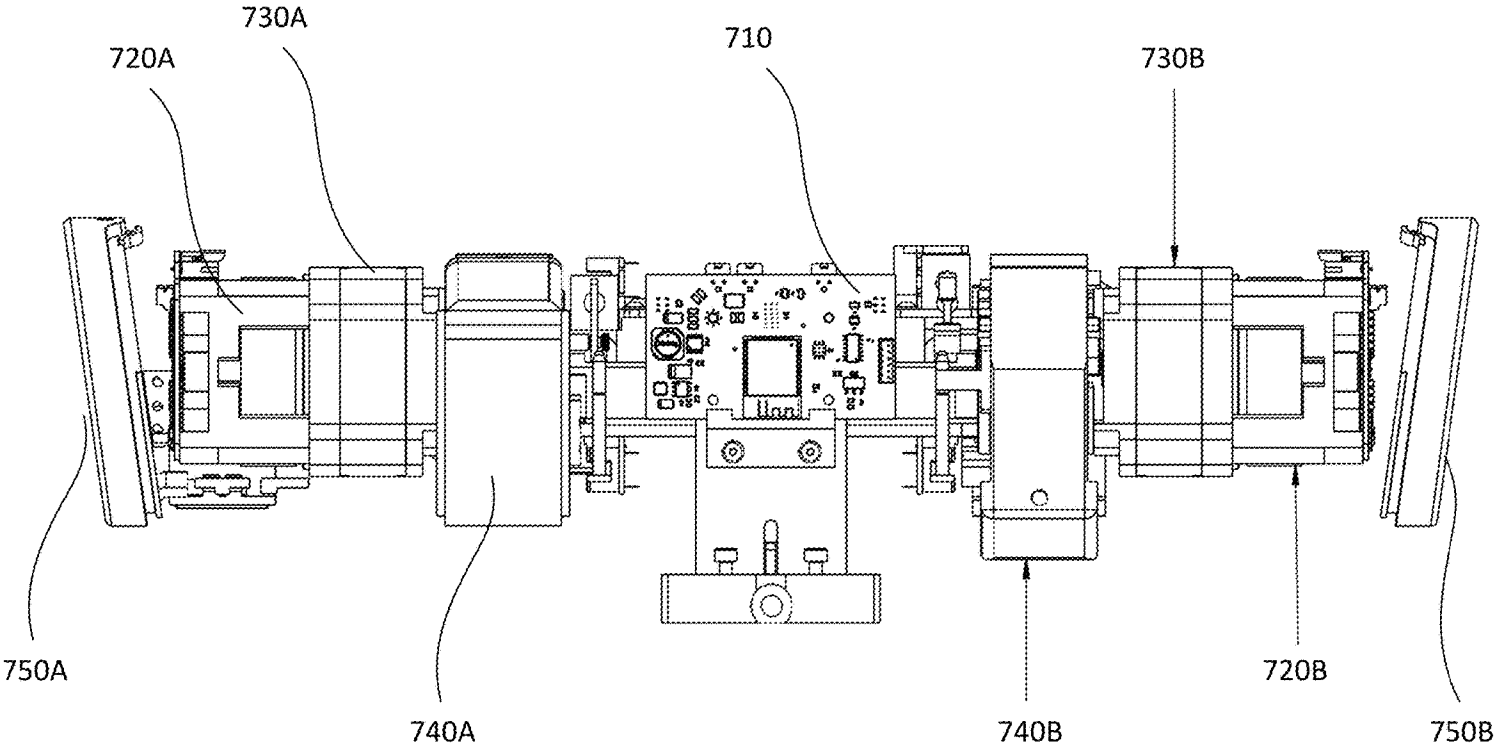

FIGS. 7A-C illustrate various views of the automated control assembly 700 used in the intelligent automated chairs. FIG. 7A illustrates a partially cut-away view of the automated control assembly 700 that is housed and integrated with the horizontal supports noted above. The automated control assembly 700 as be seen in FIGS. 7B-C have a control systems 710 and two motors 720A, 720B. The motors 720A, 720B can be brushless DC motors. These can be connected to and operate gearboxes 730A, 730B, which in turn interface with output controllers 740A, 740B that connect to the right and left leaves of the seat. An interface 750A, 750B are shown on the opposite ends of the assembly 700 and can utilized as an input interface for the assembly 700. A vertical support interface 705 is shown and configured to attach to the vertical supports previously described and shown.

The raising and lowering of the seat halves (right leaf/left leaf) is controlled and powered using the control system 710. The control system 710 can include one or more processors, memory, logic, power supply, sensors, wireless communication means, such as antennae configured to transmit and receive Bluetooth and WIFI protocols and signals. The control system 710 can further receive instructions on how to operate the controls lead to the changing of chair configurations, as shown in FIGS. 5A-D. For example, a set of operating mode instructions can be received wirelessly by the control system 710 and stored in an executable format in memory or logic to operate according to those operating mode instructions. As will be discussed in more detail below, the control system can also receive real-time feedback from the interfaces 750A and 750B, from one of the sensors, or interference when a change of position occurs to alter at least temporarily the current operating mode. This real-time feedback and input can also be used to update the current operating mode. The updating the pattern and operating mode calculation can either be performed in the control system, sent to a mobile computing device (or even the cloud) to be updated and then overriding or updating the instructions associated with the original operating mode. The control system 710 can also store usage information for later offloading and analysis in the cloud. This usage data can be part of a historical information database that include individual and/or group historical information, which is used to train and update recommended operating modes to users. It should be noted the operating modes determine the frequency of position of changes, the pattern of the position changes, the duration (e.g., 30 seconds standing, 1 minute fully sitting, 45 seconds right leg standing, 30 seconds left leg standing) of each position, the type or style of change notifications, default position when interrupted, and so forth.

Figure 8:
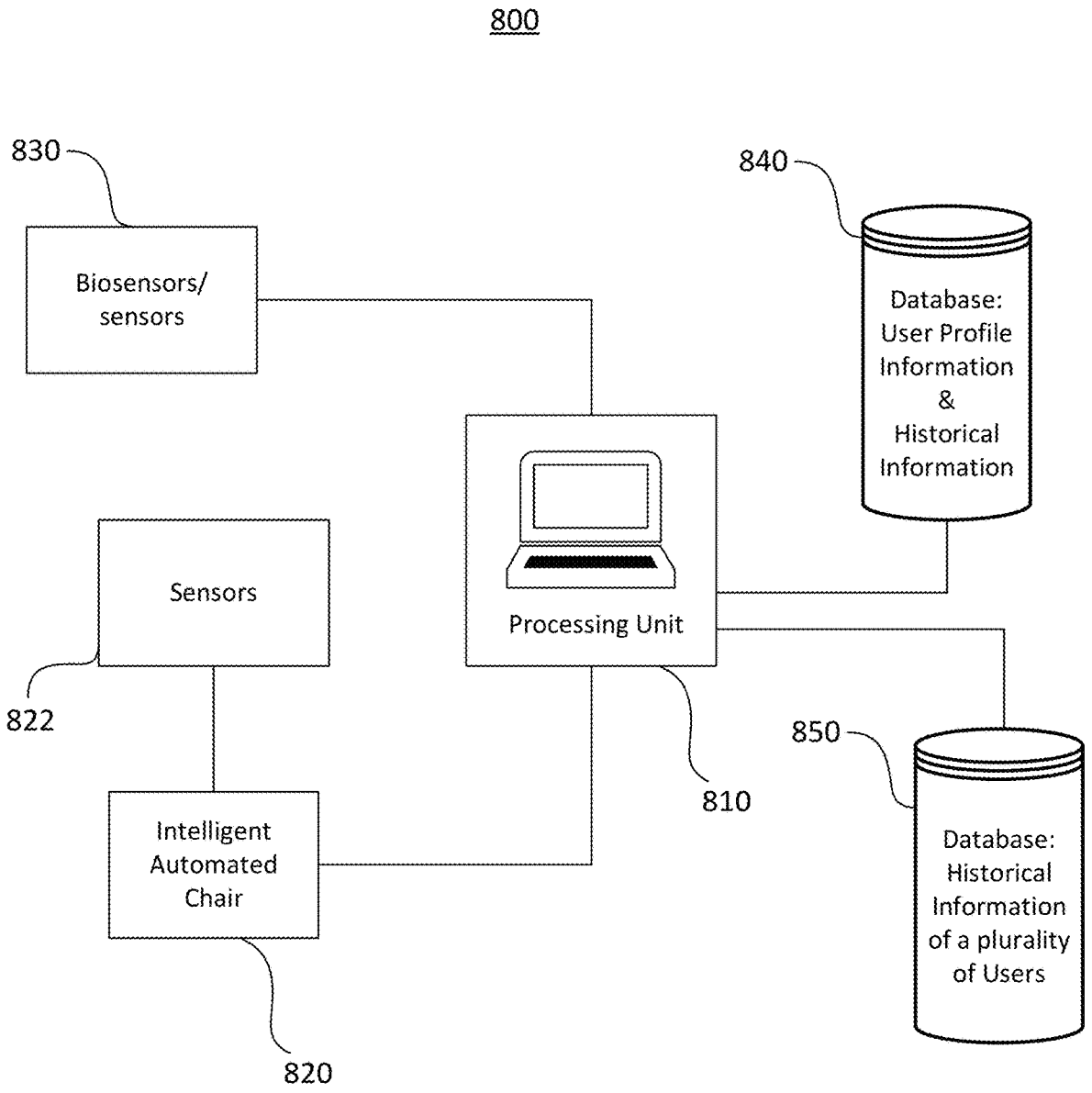
FIG. 8 illustrates a schematic of a system of an intelligent automated chair using various forms of input to determine the operation of the intelligent automated chair.

FIG. 8 illustrates a schematic of a system 800 of an intelligent automated chair using various forms of input to determine the operation of the intelligent automated chair. As shown, a computer having a processing unit 810 can receive external biosensor and other external sensor input 830, historical usage and profile information associated with the user from database 840, historical usage and profile information associated with a plurality of users from database 850, which can be used to generating an operating model for the intelligent automated chair 820. As noted above the chair 820 can further receive direct input from sensors 822. These sensors can either be integrated with the chair 820 or the sensor input information can be received directly, such as via wireless communication means.

Figure 9:
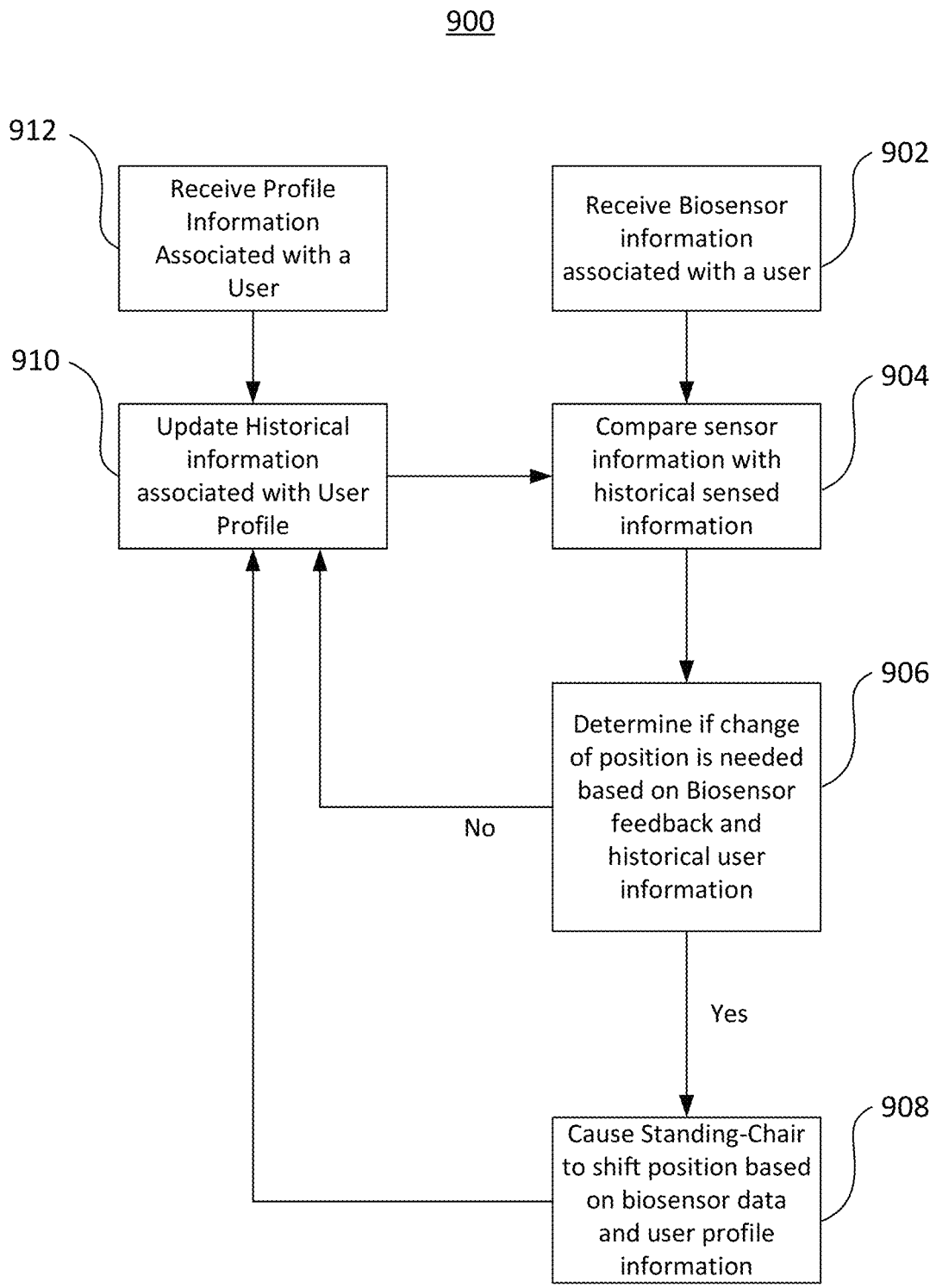
FIG. 9 illustrates a workflow indicative of at least one mode of operation determination.

FIG. 9 illustrates a workflow 900 indicative of at least one mode of operation determination. As shown, biosensor feedback 902 can be received when a user is using the intelligent automated chair, which can be compared 904 with historical biosensor information and user profile information associated with the user, an analysis 906 can be performed to determine whether or not the chair should change positions, patterns, or frequency of position changes. If the determination is positive then it is implemented in step 908 and that information is updated and stored 910 as part of the user's historical information, which incorporates user profile information 912 received by the user. It should be noted that this workflow can be performed while a user is using the intelligent automated chair, or performed at another, which then updates the operating model to be implemented the next time the user uses the intelligent automated chair.

Figure 10:
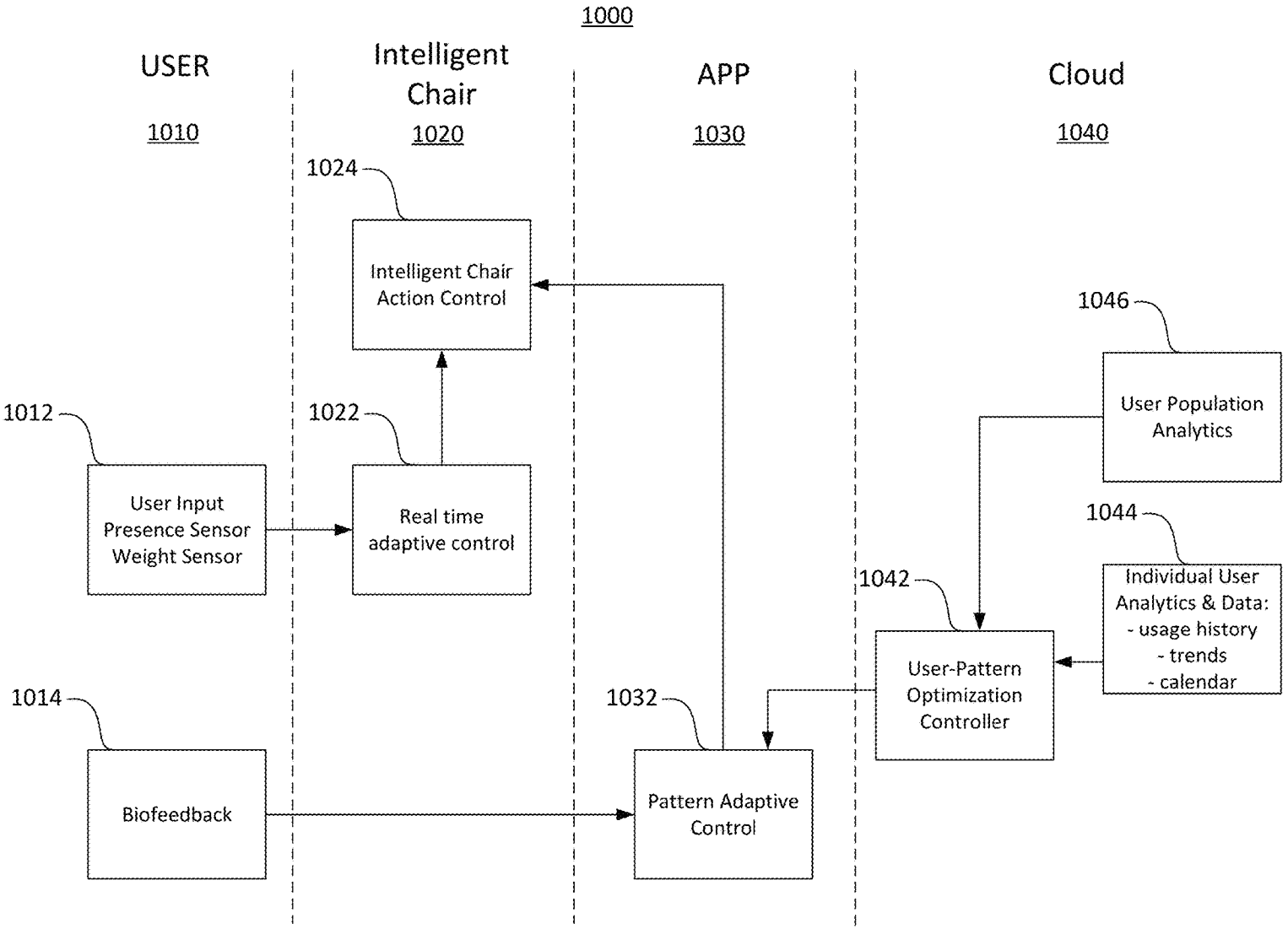
FIG. 10 illustrates a schematic where various input and decisions can occur in the intelligent automated chair system.

FIG. 10 illustrates a schematic where various input and decisions can occur in the intelligent automated chair system 1000. In one embodiment the intelligent automated chair system 1000 includes an intelligent automated chair, means to receive biosensor and other sensor information, the cloud to use stored information to generate models and recommendations and an app to interface and implement those models. In the User column 1010 the boxes 1012 and 1014 are placed indicating this is information received about the user or directly from the user, which includes receiving: user input, presence sensor information, weight information in box 1012 and biosensor information in box 1014. The information of box 1012 can be received and utilized by a real-time adaptive controller 1022 that is associated with or integrated as part of the intelligent automated chair shown in the intelligent chair column 1020. This real-time adaptive controller 1022 can process the information in real-time and then communicate with the intelligent chair action control 1024 to implement any changes in how the intelligent chair is operating. In the App column 1030, which is used to illustrate a software application, a pattern adaptive control module 1032 is provided to update the intelligent chair action control 1024 based on analysis of information performed by various modules in the cloud column 1040. As shown, a user population analytics module 1046 can receive and send such information to user pattern optimization controller 1042, which can also receive information from the user analytics module 1044. The user pattern optimization controller 1042 can generated an optimized pattern for an operating mode for a particular user. It should be noted that the user analytics module 1044 can include usage history of a user, trends of user, and even calendaring information associated with a user. For example, when the user in meetings, the historical information can identify or include information with how the user interacts with the intelligent automated chair, which could be different when the user, who for instance could be a programmer, is writing code. Thus, the calendaring information which can compare previous interactions with the user during specific type of events and can also use that same information to generate an operating model that adapts to those future events listed on the user's calendar. All of this is fed into 1046, which in turn is sent to 1032 can additionally incorporate biosensor information on top of the layer of pattern optimized information received from the cloud column.

Figure 11:
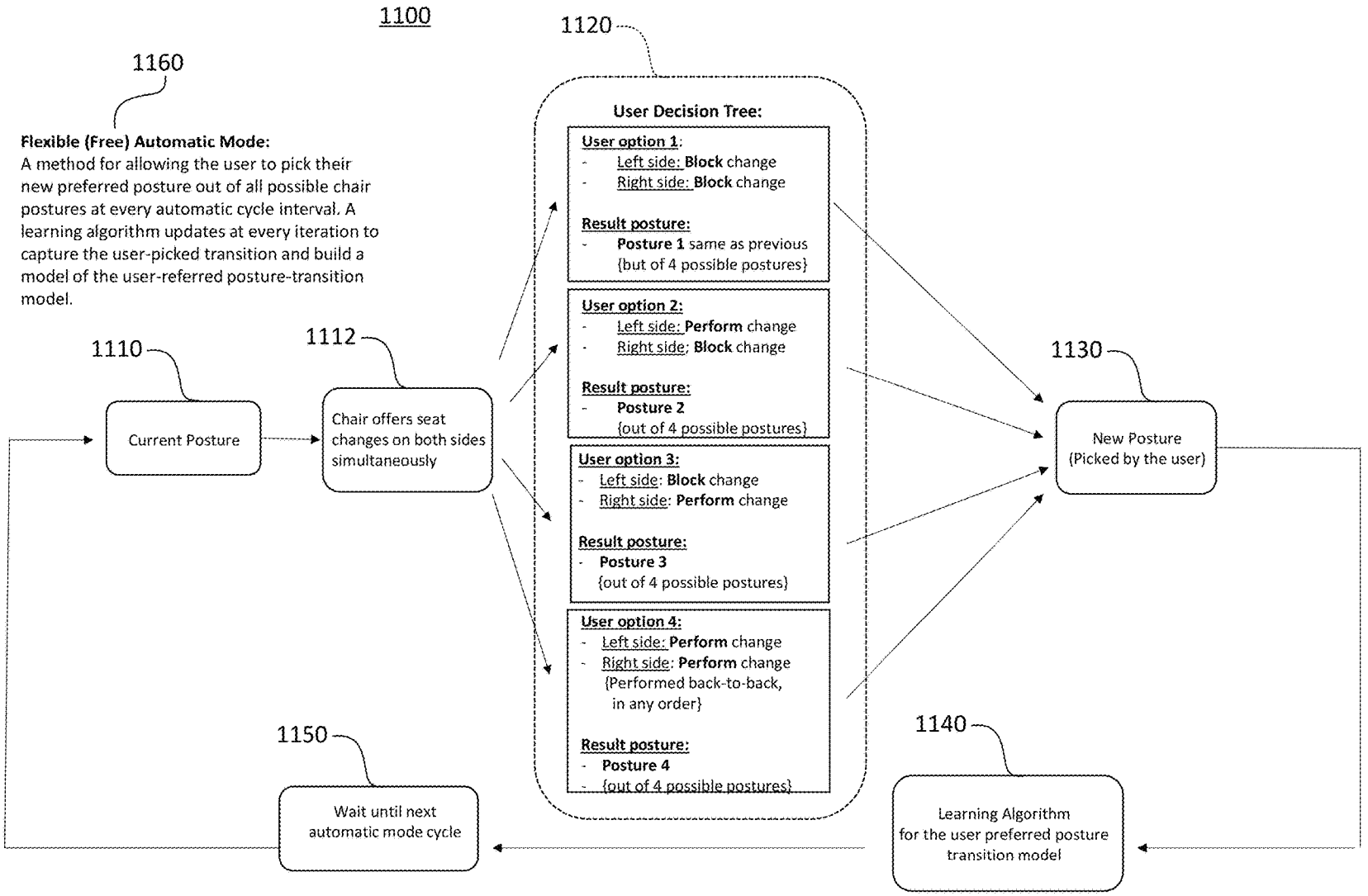
FIG. 11 illustrates one mode of operating the intelligent automated chair.

FIG. 11 illustrates one mode 1100 of operating the intelligent automated chair. This operating mode 1100 can be a flexible automatic mode 1160, which includes the ability to run an automated operating model on the intelligent automated chair that has the ability to be interrupted and take real-time feedback that can be used to updated the current automated operating model. As shown in the flowchart, the intelligent automated chair has a current position of 1110. The user has the ability to alter or change the current position as the intelligent automated chair is configured to receive user input 1112 in the middle of an automated cycle. The decisions the user can make are shown in the user decision tree of 1120. For example, if the current position is a sitting position, the user can decide under option 1, to block change on both the ride and left side, where the intelligent chair then maintains the current position determining the posture of the user. Under user option 2, the user can elect to change the left side or left leaf and block any change associated with the right side. Again, if the initial position is sitting, then the position changing to a one-leg standing position, where the left leg is standing and the right leg is resting on the right leaf. Under user option 3 the user can do the opposite, so then the left leaf remains in the same position and the right leaf alters. If the initial position were right leg standing, then with this change the user would transition to fully sitting. Under user option 4 the user has the ability to change the current position of both the left leaf and right leaf. Thus, if the previous position were sitting, then this transitions the user to a standing mode. Once the input is received with regards to the each leaf the new position is implemented in step 1130. This information of the change can then be transmitted to a learning algorithm 1140 that determines an updated way of operating that can be incorporated into the operating model, which can be implemented in step 1150 until the next automatic mode cycle happens where the circular flowchart is completed to the current position of the chair.

It should be understood that the user input can be performed in a variety of manners. One example, includes the user interfacing with control interface (112, 212, 312, 612) to determine the next position of the intelligent automated chair. Another example of the user providing input includes using more natural inputs that take advantage of various sensors implemented into the intelligent automated chair. Another form of user input, can include the user giving a voice command to a mobile computing device, which is communicated to the intelligent automated chair. Another includes selecting a new position on a control interface running on an app on a mobile computing device.

With regards to natural inputs, these can take advantage of natural user interactions. For example, if the user wants to transition from a fully sitting to a one-legged standing position the user can place their hand under the right or left leaf and lift up on the particular leaf. This input can be detected by a load detection system associated with each side. When the load sensor determines that there is an upward load it can then release the appropriate side and drop the leaf down, so the user transitions to a one-legged standing position. Another natural input can include the user reaching with the back of the foot or ankle to pull on the leaf (that is in a down or vertical position), which again can be detected or sensed by the load detection system and then cause the particular leaf to begin raising to a horizontal position. An example of a natural user input intended to block a position can include not shifting or releasing load from the right leaf, left leaf, or both sides. This can additionally include slightly pushing down on one or both sides to block the change. When the right or left leaf is trying to raise up and the user wants to keep standing, the user can push back slightly using their leg and such change in load can be detected to keep or return the leaf to the vertical position.

Figure 12:
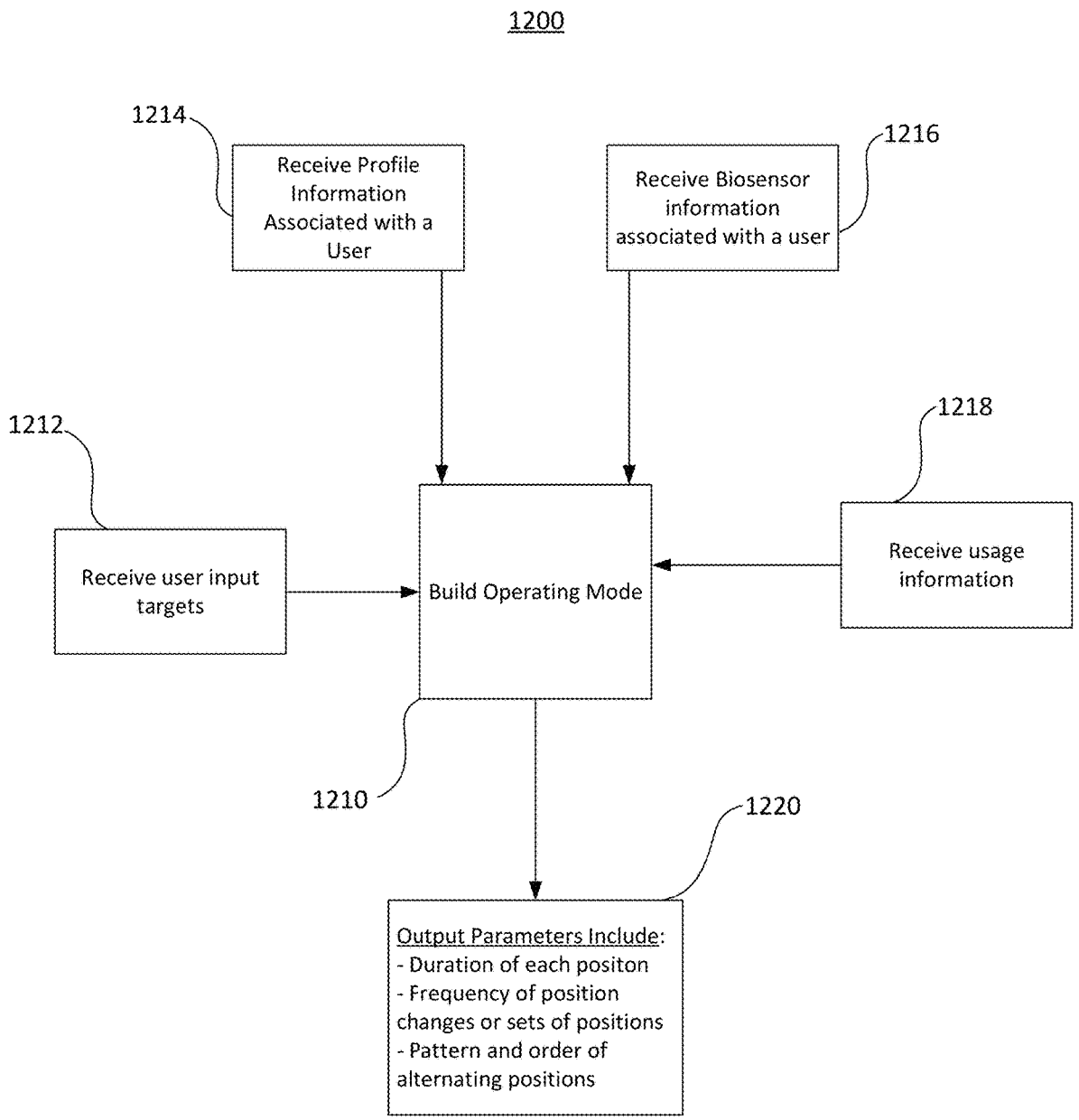
FIG. 12 illustrates a workflow for creating an operating mode and the parameters associated with the operating mode.

FIG. 12 illustrates a workflow 1200 for creating an operating mode and the parameters associated with the operating mode. Here the method includes receiving user input targets in step 1212, receiving profile information associated with a user in step 1214, receiving biosensor information associated with the user in step 1216, and receiving usage information in step 1218. This information can then be used to build an operating mode 1210 for the intelligent automated chair to operate from. The output parameters 1220 of this built operating mode can include the 1) the duration of each position, 2) the frequency of position changes and 3) pattern of rotating positions. In can also include certain targets and thresholds (min or max) to achieve. For example, the user could input a target to stand 10 minutes longer today than yesterday. There could be a target to try and keep a heart rate up a certain percentage, which can translate into changing positions more frequently or utilizing more standing positions than sitting positions. These types of user input targets are exemplary and not limited, as one of ordinary skill in this art would recognize a bevy of other types of targets or goals a user could input. These targets or goals can be daily, weekly, and so forth.

User profile information can include a variety of information such as height, weight, gender, preferences, type of job, activity level, and so forth. This information can be updated and upon updating can be used to update their user operating mode. It should also be understood that a single user can create their own operating mode by manually selecting the patterns, durations and so forth. A user could have any number of operating mode profiles that they create and can be associated with their user profile. The user can select any of their stored operating mode profiles to run using the app.

A method of training the intelligent automated chair system includes, operating the intelligent automated chair in a training mode. The training mode is configured monitor the pattern usage of the user and how they interact with the chair. This training mode usage information can then be used to recommend operating mode for the user based on the training mode. The recommended operating mode generated from the training mode usage information can further receive profile and user input target information to generate the recommended operating mode. The system can also receive other historical information associated with other users and particularly usage information of others where the user is an early or first-time user of the system.

Figure 13:
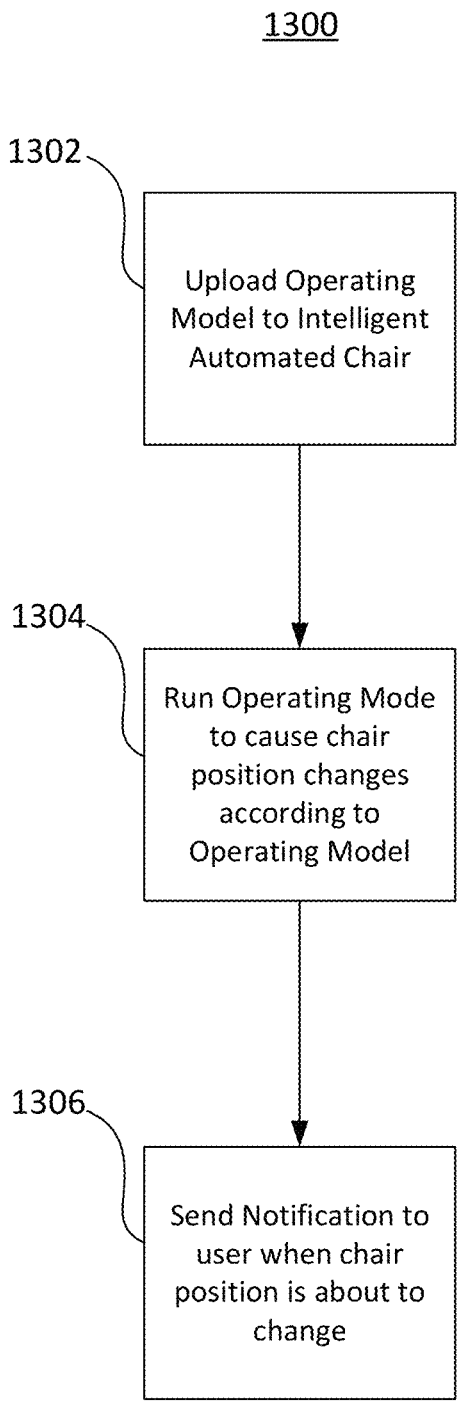
FIG. 13 illustrates a flowchart where the user receives a notification prior to the intelligent automated chair changes positions.

FIG. 13 illustrates a flowchart 1300 where the user receives a notification prior to the intelligent automated chair changes positions. The intelligent automated chair is configured to receive or have operating model uploaded to it in step 1302. In step 1304, the intelligent automated chair begins running the operating model. In step 1306, the user receives a notification prior to and when the chair is about to change positions. This notification can come in a variety of formats and determined by the user. The notifications can include, the right leaf or left leaf vibrating, an audible sound from the intelligent automated chair or smartphone, a light notification from the intelligent automated chair, smartphone or other connected device, or a physical contact by the intelligent automated chair. This physical contact can include the right or left leaf beginning to raise up and engaging the user on the back of the leg indicating that the right or left leaf is about to raise to a horizontal position.

Figure 14:
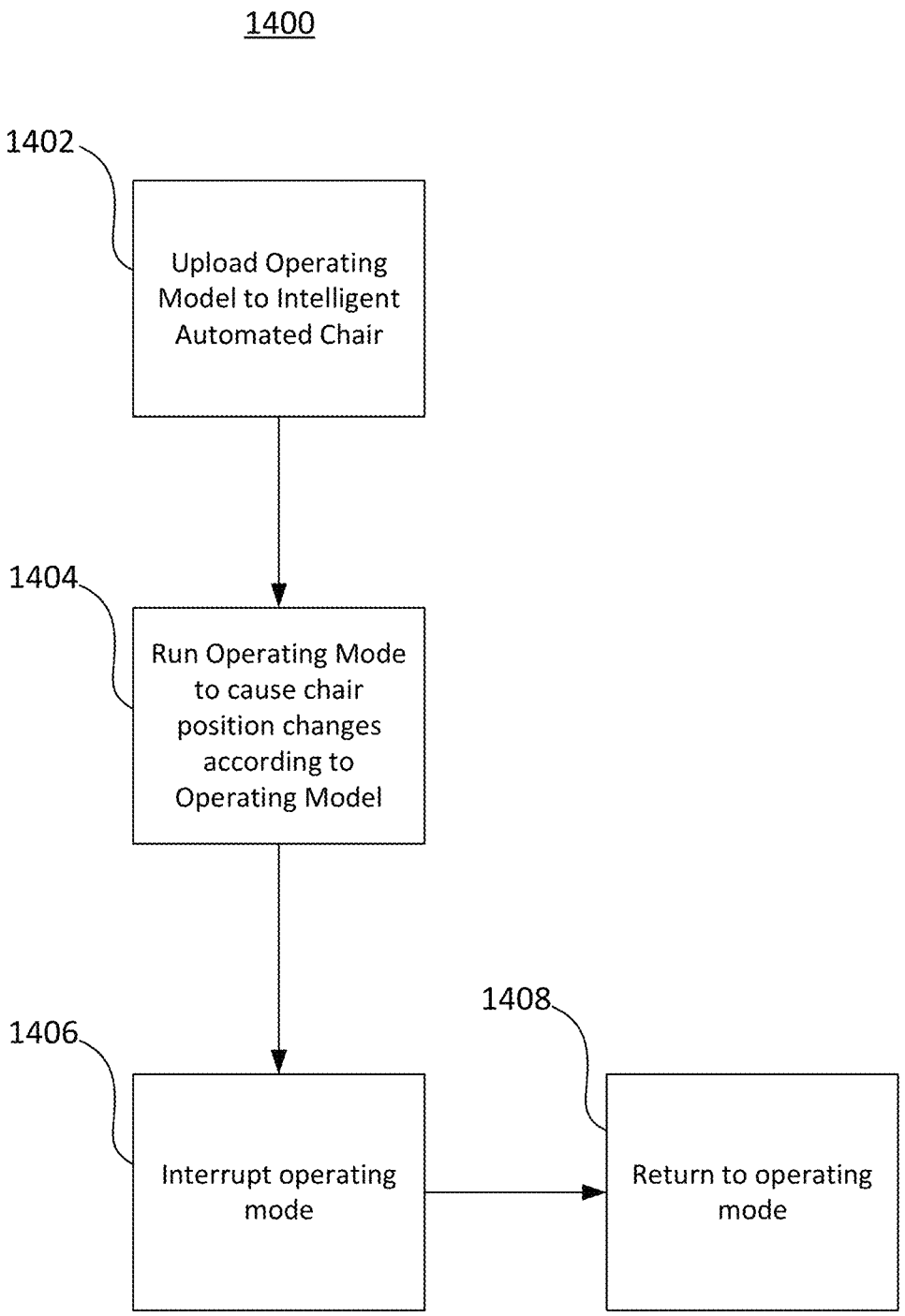
FIG. 14 is a flowchart that illustrates the interruptible nature of the intelligent automated chair.

FIG. 14 is a flowchart 1400 that illustrates the interruptible nature of the intelligent automated chair. The intelligent automated chair is configured to receive or have operating model uploaded to it in step 1402. In step 1404, the intelligent automated chair begins running the operating model. Once the intelligent automated chair begins cycling through the positions changes it can be interrupted in step 1406 for a period of time. This interruption can be the result of the user manually blocking a change, it can be an automated result of sensor determining the user is blocking the change through a sensed means, or it can be interrupted as a result of a pre-defined setting that blocks the change whenever a particular event or sensed event occurs. For example, the operating mode could be interrupted when an overhead announcement occurs, a phone call is received, another user is detected nearby, or an event such as a team meeting occurs on the user's calendar. After the interruption, the operating mode can resume its normal operating mode in step 1408.

As alluded to above, each time a user shifts positions in the intelligent automated chair, the motion can be sufficient to shift the pressure on certain parts of the user's body, such as the spine or lower back, to other parts of the user's body that allow for increased blood flow to different muscles and portions of the spine. This can help to increase blood flow to those parts of the body and keep them from becoming overstrained. The motion can also cause the heart to increase the number of beats per minute. This shifting is not akin to running on a treadmill, using other cardio equipment or strengthening equipment. A user might be able to consume information while running on a treadmill for example, but creating information becomes very difficult. The focus of cardio and strength training equipment is to reach target heart rates and optimize caloric burning. That is different from the present system and methods where the objective is optimize health benefits while maintaining, if not increasing, focus and creativity needed to performing various desk type jobs at a user's workstation as noted above.

Another one of the advantages of the system and methods described herein includes the ability for a user to alter or interrupt at their control. An intelligent automated chair can run an optimized operating model based on the various inputs described, but the user can still have control over the automated profile at any given moment and adjust or take control accordingly. Thus, allowing for the most amount of freedom or flexibility when using the intelligent automated chair.

The bio-sensed data can be received from a variety of sources including: smartwatches, smartphones, pressure sensors in the chair, IR sensors about the workstation, and other wearable devices that can track bio-sensed information.

In the various embodiments, local sensors provided about the equipment can include pressure sensors, accelerometers, flow sensors, strain sensors, humidity sensors, temperature, sound, and optical sensors.

The automated control assembly can provide instructions and incorporate with a haptic feedback driver module, which controls the haptic feedback controls of the intelligent automated chair. These haptic controls and sensors can be incorporated into various parts of the intelligent automated chair including, but not limited to: the back rest, the right and left leaves, the base, the foot pedestal (if any), a user input control module, the crossbar and support bar, and so forth. Some of these will include servo-motors or electric motors, others will be sensors, and some will include power electronics.

Some of the haptic controls and sensors can determine how much of a user's weight is resting on the standing leg as compared to the resting leg. If a user is not within a designated range (either determined by the user or recommended by the system) a haptic (or other style) of notification can occur indicating to the user to shift their weight. For example, if almost 80% of the weight of the user is placed on the standing leg, and the determined range is to not exceed 60% percent for more than a specified duration, like more than 5 seconds, then the system can create a notification to the user to shift more weight to the resting leg.

This transferring of weight and using one leg more than another can be a part of the usage information that is displayed on the app under the user's profile or account. This can be yet another type of user input target manually selected by the user or automatically recommended by the system to train the user to balance more or strengthen one side of their body over another. For example, if a user heavily favors one leg over another, this could be indicative that their back is out of alignment and needs adjusting and strengthening. With this information the user can select an operating profile or put a target input to have an operating mode updated to help facilitate this change, which might include standing more often on the weaker leg as opposed to the stronger leg.

Another aspect of the present invention is that the sensors can determine when the user is approaching and lower one or more of the chair leaves depending on the side the user is entering to engage with their workstation. Multiple user profiles can be associate with a single automated chair. Bluetooth enabled, as well as WIFI enabled watches, smartphones and other devices can communicate with the chair to modify other settings based on the user approaching to use the automated chair such as preferred operating mode profile.

Figure 15:
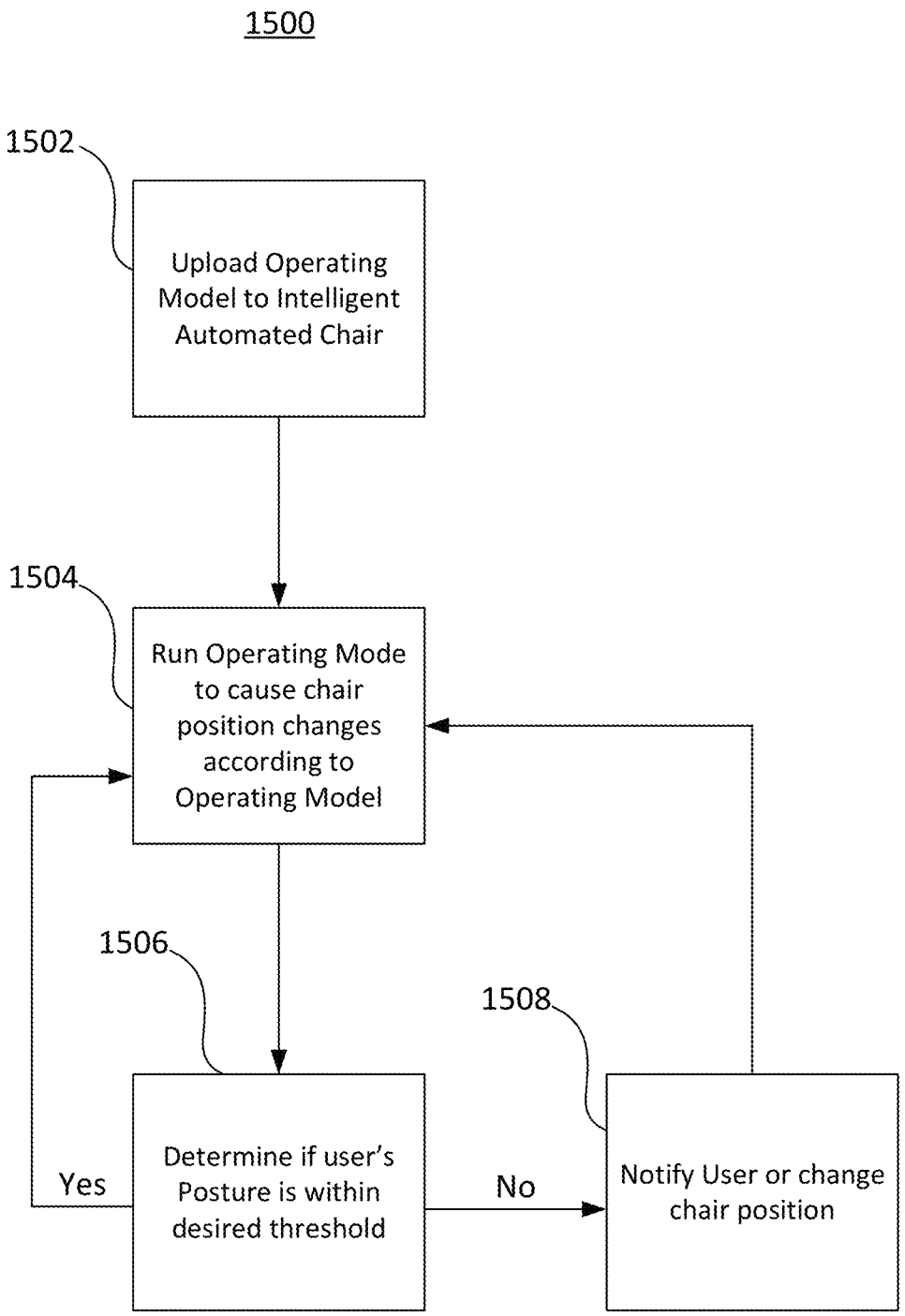
FIG. 15 illustrates a flowchart of notifying the user or interrupting the operating mode based on sensed posture information.

FIG. 15 illustrates a flowchart 1500 of notifying the user or interrupting the operating mode based on sensed posture information. The intelligent automated chair is configured to receive or have operating model uploaded to it in step 1502. In step 1504, the intelligent automated chair begins running the operating model in an operating mode. In step 1506 the system using various sensors, that can include pressure and weight sensors, to determine if the user is slouching or has an appropriate posture. If it is determined that user does not, then in step 1508 the user can be notified to change their posture through the various notification mechanisms described herein or cause the system to create an immediate chair position change.

These aspects of the invention are not meant to be exclusive and other features, aspects, and advantages of the present invention will be readily apparent to those of ordinary skill in the art when read in conjunction with the following description, appended claims, and accompanying drawings. Further, it will be appreciated that any of the various features, structures, steps, or other aspects discussed herein are for purposes of illustration only, any of which can be applied in any combination with any such features as discussed in alternative embodiments, as appropriate.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention. Additionally, any features, structures, components, method steps which are discussed in reference to any one of the aforementioned embodiments are readily adaptable for use into and with any features of the other alternative embodiments discussed therein, with the understanding that one of ordinary skill in the art will be capable of assessing the ability of the various embodiments disclosed and be capable of making such adaptations.

The invention claimed is:

1. An intelligent automated chair system comprising:
an automated chair comprising:
a base portion;
a vertical support extending from the base portion;
a horizontal support interfacing the vertical support;
a right leaf, configured to be driven by a motor in response to an input to alter between positions of horizontal and vertical;
a left leaf, configured to be driven by a motor in response to an input to alter between positions of horizontal and vertical; and
an automated control assembly housed and integrated within the horizontal support and connected to the right leaf and the left leaf, and configured to receive input data from one or more sensors and create an adjustment to at least one portion of the automated chair based on the received input data.

2. The intelligent automated chair system of claim 1, wherein the one or more sensors are biosensors that are configured to send biosensed data to a processing unit for a cloud-based system.

3. The intelligent automated chair system of claim 2, wherein the processing unit is configured to generate an automated operating model and communicate the automated operating model to the automated control assembly.

4. The intelligent automated chair system of claim 3, wherein the automated operating model includes parameters about a pattern of automatically shifting the positions of the automated chair, including durations between each shift, wherein the durations can be different for each position.

5. The intelligent automated chair system of claim 1, wherein the automated control assembly includes a control system and at least one motor.

6. The intelligent automated chair system of claim 1, wherein the automated control assembly is configured to receive and execute an operating model that has information about automatically changing positions of the automated chair according to the operating model.

7. The intelligent automated chair system of claim 6, wherein after executing the operating model, the automated control assembly can be interrupted.

8. The intelligent automated chair system of claim 7, wherein an interruption can be a result of a sensed information.

9. The intelligent automated chair system of claim 8, wherein the automated control assembly is configured to use information associated with the interruption to update the operating model.

10. The intelligent automated chair system of claim 6, further including a haptic feedback control incorporated into at least one of the base portion, the vertical support, the horizontal support, the right leaf, or the left leaf, wherein the haptic feedback control is configured to notify a user when a position change is about to occur.

11. The intelligent automated chair system of claim 1, further including a load detection system associated with at least one of the right leaf or the left leaf, wherein the load detection system is configured to determine if a posture threshold is being met.

12. The intelligent automated chair system of claim 11, whereupon determining the posture threshold is not being met, executing by the automated control assembly either a notification or a position change of the right leaf or the left leaf.

13. The intelligent automated chair system of claim 1, further including a processing unit for a cloud-based system.

14. The intelligent automated chair system of claim 13, wherein the processing unit is configured to receive at least two of usage information, profile information, user input data, and biosensed data to generate an operating model.

15. The intelligent automated chair system of claim 1, wherein the automated control assembly is configured to monitor and record usage information associated with a user including the sequence of position changes and the duration between each position change.

16. The intelligent automated chair system of claim 1, wherein the recorded usage information is used in a processing unit to generate a recommended operating model for the user.

17. An intelligent automated chair system comprising:
an automated chair comprising:
a base portion;
a vertical support extending from the base portion;
a horizontal support interfacing the vertical support;
a right leaf, configured to be driven by a motor in response to an input to alter between positions of horizontal and vertical;
a left leaf, configured to be driven by a motor in response to an input to alter between positions of horizontal and vertical; and
an automated control assembly housed and integrated within the horizontal support and connected to the right leaf and the left leaf, and configured to receive an updatable operating model based on at least one of profile information, biosensed data, or usage data.

18. The intelligent automated chair system of claim 17, wherein the automated control assembly is configured to execute the updatable operating model, which causes position changes to the automated chair according to the updatable operating model.

19. The intelligent automated chair system of claim 17, further including a plurality of sensors in communication with the automated control assembly.

20. The intelligent automated chair system of claim 19, wherein the plurality of sensors are configured to determine if a natural input received by the system from a user is indicative of changing a position of the automated chair.

21. The intelligent automated chair system of claim 20, whereupon determining and updating the position of the automated chair according to the natural input, the updatable operating model is updated with the usage information associated with the natural input.

* * * * *